US008824926B2

(12) United States Patent
Egi

(10) Patent No.: US 8,824,926 B2
(45) Date of Patent: Sep. 2, 2014

(54) FIXING DEVICE INCLUDING BELT GUIDE MEMBER AND IMAGE FORMING APPARATUS INCLUDING THE SAME

(75) Inventor: Makoto Egi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 234 days.

(21) Appl. No.: 13/326,650

(22) Filed: Dec. 15, 2011

(65) Prior Publication Data

US 2012/0155918 A1 Jun. 21, 2012

(30) Foreign Application Priority Data

Dec. 17, 2010 (JP) ..... 2010-281495
Oct. 17, 2011 (JP) ..... 2011-228006

(51) Int. Cl.
*G03G 15/20* (2006.01)
*G03G 15/16* (2006.01)

(52) U.S. Cl.
USPC ..... 399/122; 399/329

(58) Field of Classification Search
CPC ..... G03G 2215/0132; G03G 15/2053
USPC ..... 399/122, 329
See application file for complete search history.

(56) References Cited

U.S. PATENT DOCUMENTS 7,079,800 B2 * 7/2006 Asakura et al. ..... 399/328
7,369,801 B2 * 5/2008 Tsueda et al. ..... 399/328
7,390,995 B2 * 6/2008 Hasegawa et al. ..... 219/619
7,529,515 B2 * 5/2009 Tsueda et al. ..... 399/328
7,778,581 B2 * 8/2010 Seo et al. ..... 399/328
2005/0281595 A1 12/2005 Kachi
2006/0285893 A1 12/2006 Ishii
2007/0014601 A1 * 1/2007 Yasuda et al. ..... 399/329
2007/0019063 A1 * 1/2007 Yasuda et al. ..... 347/223
2007/0122214 A1 * 5/2007 Samei et al. ..... 399/329
2009/0263168 A1 * 10/2009 Baba ..... 399/329
2010/0086335 A1 * 4/2010 Sugaya ..... 399/329
2010/0178088 A1 * 7/2010 Koshida et al. ..... 399/328
2010/0322682 A1 * 12/2010 Baba ..... 399/329
2011/0150546 A1 * 6/2011 Koshida ..... 399/329

FOREIGN PATENT DOCUMENTS

JP 2002124371 A * 4/2002 ..... H05B 6/14
JP 2003263045 A * 9/2003 ..... G03G 15/20

(Continued)

OTHER PUBLICATIONS

Machine translation of JP 2009-288281.*

*Primary Examiner* — David Bolduc
(74) *Attorney, Agent, or Firm* — Frommer Lawrence & Haug LLP

(57) ABSTRACT

A fixing device includes a fixing rotator unit and an induction heating portion. The fixing rotator unit includes a heating rotary belt, a pressing member being in contact with the inner surface of the heating rotary belt, a pressurizing rotator forming a fixing nip between the pressurizing rotator and the pressing member, a belt guide member including a guide portion and an extending portion, positioning the heating rotary belt, and guiding rotation. The induction heating portion includes a magnetic-flux generating portion, a magnetic core portion, and a support member supporting the magnetic-flux generating portion. The support member includes a positioning portion that positions the belt guide member by coming into contact with or engaging the extending portion to control a distance between the magnetic-flux generating portion and the outer surface of the heating rotary belt.

10 Claims, 11 Drawing Sheets

(56) References Cited

FOREIGN PATENT DOCUMENTS

| | | | | |
|---|---|---|---|---|
| JP | 2005070376 A | * | 3/2005 | ..... G03G 15/20 |
| JP | 2006-047988 A | | 2/2006 | |
| JP | 2006-350054 | | 12/2006 | |
| JP | 2009-288281 A | | 12/2009 | |

* cited by examiner

FIXING DEVICE INCLUDING BELT GUIDE MEMBER AND IMAGE FORMING APPARATUS INCLUDING THE SAME

INCORPORATION BY REFERENCE

This application is based upon and claims the benefit of priority from the corresponding Japanese Patent application No. 2010-281495, filed Dec. 17, 2010, and Japanese Patent application No. 2011-228006, filed Oct. 17, 2011, the entire contents of which are incorporated herein by reference.

FIELD

The present disclosure relates to a fixing device and an image forming apparatus including the same.

BACKGROUND

For an image forming apparatus, such as a printer or a copier, because of demands for a reduction in a rise time (time from power-on of an image forming apparatus to a state in which a fixing device becomes able to fix an image) and energy saving, and other demands, attention is directed to a fixing device that uses a heating rotary belt capable of having small thermal capacity. Attention is also directed to a induction-heating fixing device that includes an induction heating portion as means for heating a heating rotary belt at a location that faces the outer surface of the heating rotary belt and heats the heating rotary belt by causing the heat generation layer of the heating rotary belt to generate heat using an electromagnetic induction action produced by a magnetic flux generated by an induction coil (magnetic-flux generating portion) of the induction heating portion.

For an induction-heating fixing device, the positional relationship between the outer circumferential surface of a heating rotary belt and an induction coil may be changed by thermal expansion of a pressure rotary roller. In this case, the heating efficiency of the fixing device varies and is uneven, power consumption tends to increase, and the rise time of the fixing device is apt to vary.

Another proposed example of a fixing device is the one that positions the outer circumferential surface of a heating rotary roller with respect to an induction heating portion to reduce a change in the positional relationship between the heating rotary roller and an induction coil. The proposed fixing device has a configuration in which the induction heating portion is urged toward a bearing portion of the heating rotary roller by an urging member arranged between the induction heating portion and the bearing portion of the heating rotary roller, and the induction heating portion is positioned.

Unfortunately, the fixing device using the heating rotary belt capable of having small thermal capacity does not have a bearing portion as in the proposed fixing device, so it is difficult to urge the induction heating portion toward the heating rotary belt and position the induction heating portion. Such difficulty in positioning may lead to uneven heating efficiencies of the heating rotary belt in the direction of the rotation axis of the heating rotary belt (i.e., the paper width direction) or variations in heating efficiency between produced fixing devices. In the former, the temperature is not even in the direction of the rotation axis of the heating rotary belt; in the latter, the fixing devices have different rise times. Thus, it is desired that a fixing device be capable of having a uniform distance between an induction coil and the outer circumferential surface of a heating rotary belt.

SUMMARY

The present disclosure relates to a fixing device capable of having a uniform distance between an induction coil (magnetic-flux generating portion) and the outer circumferential surface of a heating rotary belt. The present disclosure also relates to an image forming apparatus that includes the fixing device.

A fixing device according to an aspect of some embodiments of the present disclosure includes a fixing rotator unit and an induction heating portion. The fixing rotator unit includes a heating rotary belt, a pressing member arranged inside the heating rotary belt and being in contact with an inner surface of the heating rotary belt, a pressurizing rotator arranged so as to face the heating rotary belt, the heating rotary belt being sandwiched between the pressing member and the pressurizing rotator, the pressurizing rotator and the heating rotary belt forming a fixing nip therebetween, and a belt guide member including a guide portion being in contact with the inner surface of the heating rotary belt and an extending portion that extends from the guide portion, positioning the heating rotary belt, and guiding rotation of the heating rotary belt. The induction heating portion includes a magnetic-flux generating portion arranged so as to face an outer surface of the heating rotary belt and generating a magnetic flux for causing the heating rotary belt to generate heat, a magnetic core portion forming a magnetic path for the magnetic flux generated by the magnetic-flux generating portion, and a support member supporting the magnetic-flux generating portion and facing the outer surface of the heating rotary belt. The support member includes a positioning portion that positions the belt guide member by coming into contact with or engaging the extending portion to control a distance between the magnetic-flux generating portion and the outer surface of the heating rotary belt.

An image forming apparatus according to another aspect of some embodiments of the present disclosure includes an image bearing member that has a surface on which an electrostatic latent image is capable of being formed, a developing device for developing the electrostatic latent image formed on the image bearing member as a toner image, a transferring portion for directly or indirectly transferring the toner image formed on the image bearing member to a recording medium, and a fixing device for fixing, on the recording medium, the toner image transferred to the recording medium. The fixing device includes a fixing rotator unit and an induction heating portion. The fixing rotator unit includes a heating rotary belt, a pressing member arranged inside the heating rotary belt and being in contact with an inner surface of the heating rotary belt, a pressurizing rotator arranged so as to face the heating rotary belt, the heating rotary belt being sandwiched between the pressing member and the pressurizing rotator, the pressurizing rotator and the heating rotary belt fanning a fixing nip therebetween, and a belt guide member including a guide portion being in contact with the inner surface of the heating rotary belt and an extending portion that extends from the guide portion, positioning the heating rotary belt, and guiding rotation of the heating rotary belt. The induction heating portion includes a magnetic-flux generating portion arranged so as to face an outer surface of the heating rotary belt and generating a magnetic flux for causing the heating rotary belt to generate heat, a magnetic core portion forming a magnetic path for the magnetic flux generated by the magnetic-flux generating portion, and a support member supporting the magnetic-flux generating portion and facing the outer surface of the heating rotary belt. The support member includes a positioning portion that positions the belt guide member by coming into contact with or engaging the extending portion to control a distance between the magnetic-flux generating portion and the outer surface of the heating rotary belt.

The above and other objects, features, and advantages of various embodiments of the present disclosure will be more apparent from the following detailed description of embodiments taken in conjunction with the accompanying drawings.

In this text, the terms "comprising", "comprise", "comprises" and other forms of "comprise" can have the meaning ascribed to these terms in U.S. Patent Law and can mean "including", "include", "includes" and other forms of "include". The phrase "an embodiment" as used herein does not necessarily refer to the same embodiment, though it may. In addition, the meaning of "a," "an," and "the" include plural references; thus, for example, "an embodiment" is not limited to a single embodiment but refers to one or more embodiments. As used herein, the term "or" is an inclusive "or" operator, and is equivalent to the term "and/or," unless the context clearly dictates otherwise. The term "based on" is not exclusive and allows for being based on additional factors not described, unless the context clearly dictates otherwise.

Various features of novelty which characterize various aspects of the disclosure are pointed out in particularity in the claims annexed to and forming a part of this disclosure. For a better understanding of the disclosure, operating advantages and specific objects that may be attained by some of its uses, reference is made to the accompanying descriptive matter in which exemplary embodiments of the disclosure are illustrated in the accompanying drawings in which corresponding components are identified by the same reference numerals.

BRIEF DESCRIPTION OF THE DRAWINGS

The following detailed description, given by way of example, but not intended to limit the disclosure solely to the specific embodiments described, may best be understood in conjunction with the accompanying drawings, in which.

DETAILED DESCRIPTION OF EMBODIMENTS

Reference will now be made in detail to various embodiments of the disclosure, one or more examples of which are illustrated in the accompanying drawings. Each example is provided by way of explanation of the disclosure, and by no way limiting the present disclosure. In fact, it will be apparent to those skilled in the art that various modifications, combinations, additions, deletions and variations can be made in the present disclosure without departing from the scope or spirit of the present disclosure. For instance, features illustrated or described as part of one embodiment can be used in another embodiment to yield a still further embodiment. It is intended that the present disclosure covers such modifications, combinations, additions, deletions, applications and variations that come within the scope of the appended claims and their equivalents.

Embodiments of the present disclosure are described below with reference to the drawings. The present disclosure is not limited to the embodiments described below, and various modifications can be made within the scope of the idea of the present disclosure.

Figure 1:
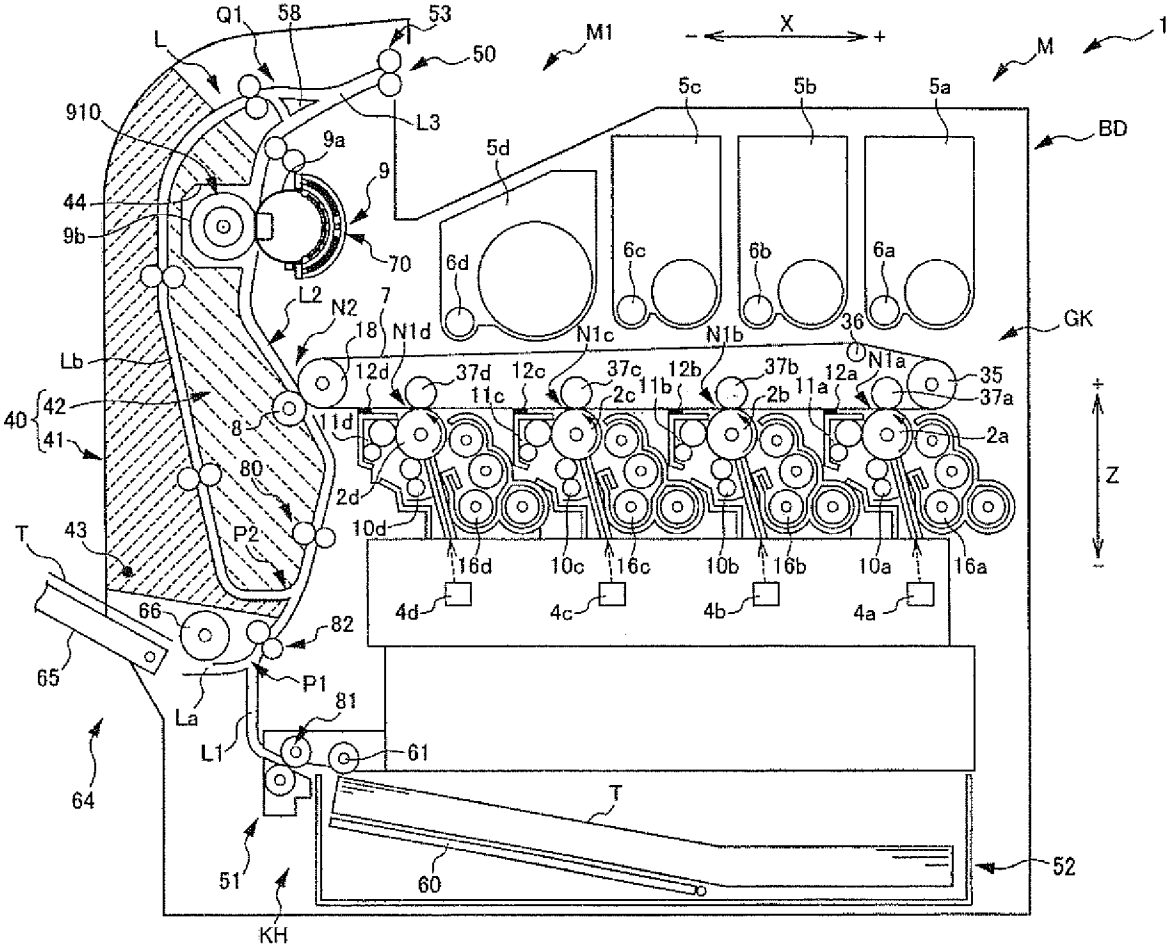
FIG. 1 is an illustration for describing an arrangement of components of a printer according to an embodiment of the present disclosure.
Figure 2:
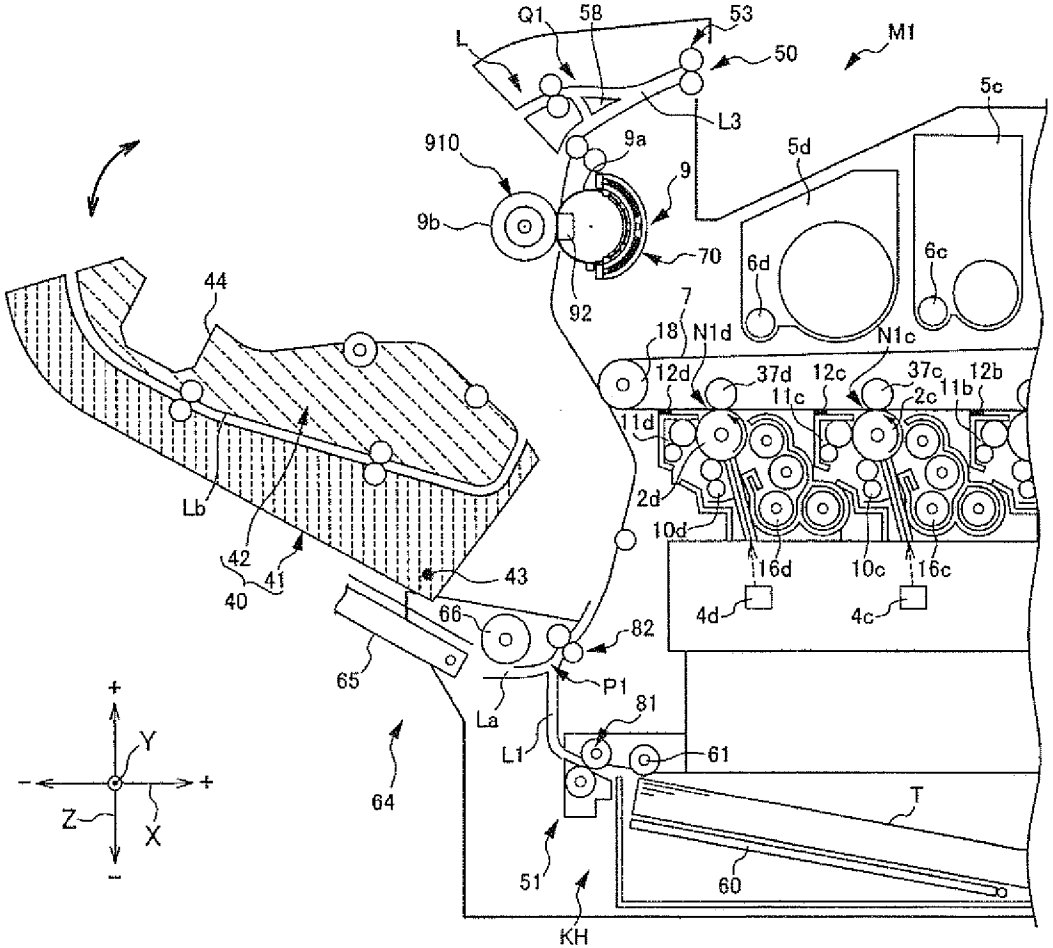
FIG. 2 is an illustration for describing a state in which a cover member of the printer according to the embodiment of FIG. 1 is in an opened position.

A general structure of a printer 1 as an image forming apparatus according to some embodiments is described using FIGS. 1 and 2. FIG. 1 is an illustration for describing an arrangement of components of the printer 1 according to an embodiment of the present disclosure. FIG. 2 is an illustration for describing a state in which a cover member 40 of the printer 1 of FIG. 1 is in an opened position.

As illustrated in FIG. 1, the printer 1 according to the illustrative embodiment includes an apparatus main body M. The apparatus main body M includes an image forming portion GK for forming a toner image on paper T as a recording medium on the basis of image information and a paper feed and eject portion KH for feeding the paper T to the image forming portion GK and ejecting the paper T with the toner image formed thereon. The external shape of the apparatus main body M is formed by a casing body BD as a housing.

As illustrated in FIG. 1, the image forming portion GK includes photosensitive drums 2*a*, 2*b*, 2*c*, and 2*d* as an image bearing member (photosensitive member), charging portions 10*a*, 10*b*, 10*c*, and 10*d*, laser scanner units 4*a*, 4*b*, 4*c*, and 4*d* as an exposure unit, developing devices 16*a*, 16*b*, 16*c*, and 16*d*, toner cartridges 5*a*, 5*b*, 5*c*, and 5*d*, toner supply portions 6*a*, 6*b*, 6*c*, and 6*d*, drum cleaning portions 11*a*, 11*b*, 11*c*, and 11*d*, neutralization devices 12*a*, 12*b*, 12*c*, and 12*d*, an intermediate transfer belt 7, primary transfer rollers 37*a*, 37*b*, 37*c*, and 37*d*, a secondary transfer roller 8, an opposite roller 18, and a fixing device 9.

As illustrated in FIG. 1, the paper feed and eject portion KH includes a paper feed cassette 52, a transport path L for the paper T, a pair of registration rollers 80, a plurality of or a pair of rollers, and a paper ejection portion 50.

The configuration of each of the image forming portion GK and the paper feed and eject portion KH is described in detail below. First, the image forming portion GK according to some embodiments is described.

In the image foaming portion GK, in the order from upstream to downstream, charging by the charging portions 10*a*, 10*b*, 10e, and 10*d*, exposure by the laser scanner units 4*a*, 4*b*, 4*c*, and 4*d*, development by the developing devices 16*a*, 16*b*, 16*c*, and 16*d*, primary transferring by the intermediate transfer belt 7 and the primary transfer rollers 37*a*, 37*b*, 37*c*, and 37*d*, static elimination by the neutralization devices 12*a*, 12*b*, 12*c*, and 12*d*, and cleaning by the drum cleaning portions 11*a*, 11*b*, 11*c*, and 11*d* are performed in sequence over the surfaces of the photosensitive drums 2*a*, 2*b*, 2*c*, and 2*d*.

In the image forming portion GK, secondary transferring by the intermediate transfer belt 7, the secondary transfer roller 8, and the opposite roller 18, and fixation by the fixing device 9 are also carried out.

Each of the photosensitive drums 2*a*, 2*b*, 2*c*, and 2*d* is substantially cylindrical and functions as a photosensitive member or an image bearing member. Each of the photosensitive drums 2*a*, 2*b*, 2*c*, and 2*d* is arranged so as to be able to rotate in the direction indicated by the arrow illustrated in FIG. 1 about a rotation axis extending in the direction substantially perpendicular to the direction of movement of the intermediate transfer belt 7. Each of the photosensitive drums 2*a*, 2*b*, 2*c*, and 2*d* has a surface on which an electrostatic latent image can be formed.

The charging portions 10*a*, 10*b*, 10*c*, and 10*d* are arranged so as to face the surfaces of the photosensitive drums 2*a*, 2*b*, 2*c*, and 2*d*, respectively. The charging portions 10*a*, 10*b*, 10*c*, and 10*d* evenly charge the surfaces of the photosensitive drums 2*a*, 2*b*, 2*c*, and 2*d*, respectively, negatively (negative polarity) or positively (positive polarity).

The laser scanner units 4*a*, 4*b*, 4*c*, and 4*d* function as the exposure units and are spaced away from the surfaces of the photosensitive drums 2*a*, 2*b*, 2*c*, and 2*d*, respectively.

The laser scanner units 4*a*, 4*b*, 4*c*, and 4*d* can form electrostatic latent images on the surfaces of the photosensitive drums 2*a*, 2*b*, 2*c*, and 2*d*, respectively, by scanning and exposing the surfaces of the photosensitive drums 2*a*, 2*b*, 2*c*, and 2*d*, respectively, on the basis of image information input from an external device, such as a personal computer.

The developing devices 16*a*, 16*b*, 16*c*, and 16*d* are disposed so as to correspond to the photosensitive drums 2*a*, 2*b*, 2*c*, and 2*d*, respectively, and face the surfaces of the photosensitive drums 2*a*, 2*b*, 2*c*, and 2*d*, respectively. The developing devices 16*a*, 16*b*, 16*c*, and 16*d* deposit toners of corresponding colors on the electrostatic latent images formed on the surfaces of the photosensitive drums 2*a*, 2*b*, 2*c*, and 2*d*, respectively, and form toner images of corresponding colors on the surfaces of the photosensitive drums 2*a*, 2*b*, 2*c*, and 2*d*, respectively. The developing devices 16*a*, 16*b*, 16*c*, and 16*d* correspond to four colors of yellow, cyan, magenta, and black, respectively. The developing devices 16*a*, 16*b*, 16*c*, and 16*d* are configured to include respective development rollers that face the surfaces of the photosensitive drums 2*a*, 2*b*, 2*c*, and 2*d*, respectively, and respective stirring rollers for stirring toner.

The toner cartridges 5*a*, 5*b*, 5*c*, and 5*d* are disposed so as to correspond to the developing devices 16*a*, 16*b*, 16*c*, and 16*d*, respectively, and hold toners of corresponding colors to be supplied to the developing devices 16*a*, 16*b*, 16*c*, and 16*d*, respectively. The toner cartridges 5*a*, 5*b*, 5*c*, and 5*d* hold yellow toner, cyan toner, magenta toner, and black toner, respectively.

The toner supply portions 6*a*, 6*b*, 6*c*, and 6*d* are disposed so as to correspond to the toner cartridges 5*a*, 5*b*, 5*c*, and 5*d*, respectively, and the developing devices 16*a*, 16*b*, 16*c*, and 16*d*, respectively. The toner supply portions 6*a*, 6*b*, 6*c*, and 6*d* supply the toners of corresponding colors held in the toner cartridges 5*a*, 5*b*, 5*c*, and 5*d*, respectively, to the developing devices 16*a*, 16*b*, 16*c*, and 16*d*, respectively.

Toner images of corresponding colors formed on the surfaces of the photosensitive drums 2*a*, 2*b*, 2*c*, and 2*d* are primarily transferred to the intermediate transfer belt 7 in sequence. The intermediate transfer belt 7 is stretched around a driven roller 35, the opposite roller 18 being a driving roller, and a tension roller 36. The tension roller 36 urges the intermediate transfer belt 7 from inside to outside, and thus a predetermined tension is applied to the intermediate transfer belt 7.

The primary transfer rollers 37*a*, 37*b*, 37*c*, and 37*d* are arranged so as to face the photosensitive drums 2*a*, 2*b*, 2*c*, and 2*d*, respectively, with the intermediate transfer belt 7 being disposed therebetween.

The intermediate transfer belt 7 is sandwiched between each of the primary transfer rollers 37*a*, 37*b*, 37*c*, and 37*d* and each of the photosensitive drums 2*a*, 2*b*, 2*c*, and 2*d*, respectively. The sandwiched parts of the intermediate transfer belt 7 are pressed against the photosensitive drums 2*a*, 2*b*, 2*c*, and 2*d*, respectively. Primary transfer nips N1*a*, N1*b*, N1*c*, and N1*d* are formed between the photosensitive drums 2*a*, 2*b*, 2*c*, and 2*d* and the primary transfer rollers 37*a*, 37*b*, 37*c*, and 37*d*, respectively. Toner images of corresponding colors on the photosensitive drums 2*a*, 2*b*, 2*c*, and 2*d* are primarily transferred to the intermediate transfer belt 7 in sequence at the primary transfer nips N1*a*, N1*b*, N1*c*, and N1*d*, respectively. In this manner, a full-color toner image is formed on the intermediate transfer belt 7.

The neutralization devices 12*a*, 12*b*, 12*c*, and 12*d* are arranged so as to face the surfaces of the photosensitive drums 2*a*, 2*b*, 2*c*, and 2*d*, respectively.

The drum cleaning portions 11*a*, 11*b*, 11*c*, and 11*d* are arranged so as to face the surfaces of the photosensitive drums 2*a*, 2*b*, 2*c*, and 2*d*, respectively.

The secondary transfer roller 8 secondarily transfers the full-color toner image primarily transferred to the intermediate transfer belt 7 to the paper T. A secondary transfer bias for use in transferring the full-color toner image formed on the intermediate transfer belt 7 to the paper T is applied to the secondary transfer roller 8 by a secondary transfer bias applying portion (not illustrated).

The secondary transfer roller 8 can come into contact with and separate from the intermediate transfer belt 7. Specifically, the secondary transfer roller 8 can move between a contact position at which it is in contact with the intermediate transfer belt 7 and a separated position at which it is spaced away from the intermediate transfer belt 7.

The opposite roller 18 is arranged so as to be opposite to the secondary transfer roller 8 with the intermediate transfer belt 7 being disposed therebetween. The intermediate transfer belt 7 is sandwiched between the secondary transfer roller 8 and the opposite roller 18. The paper T is pressed against the outer surface (the surface to which the toner image has been primarily transferred) of the intermediate transfer belt 7. A secondary transfer nip N2 is formed between the intermediate transfer belt 7 and the secondary transfer roller 8. The full-color toner image primarily transferred to the intermediate transfer belt 7 is secondarily transferred to the paper T at the secondary transfer nip N2.

The fixing device 9 fuses and pressurizes toners of corresponding colors forming the toner image secondarily transferred to the paper T to fix the toner image on the paper T. The details of the configuration relating to the fixing device 9 according to some embodiments are described below.

Next, the paper feed and eject portion KH is described in accordance with some embodiments.

As illustrated in FIG. 1, the paper feed cassette 52 for accommodating paper T is arranged in the lower part of the apparatus main body M. A mounting plate 60 on which the papers T is placed is arranged on the paper feed cassette 52.

The paper T placed on the mounting plate 60 is sent to the transport path L by a cassette paper feed portion 51. The cassette paper feed portion 51 includes a double feed prevention mechanism including a forward feed roller 61 for picking up the paper T on the mounting plate 60 and a pair of paper feed rollers 81 for sending the paper T one by one to the transport path L.

The transport path L along which the paper T is transported includes a first transport path L1 from the cassette paper feed portion 51 to the secondary transfer nip N2, a second transport path L2 from the secondary transfer nip N2 to the fixing device 9, a third transport path L3 from the fixing device 9 to the paper ejection portion 50, and a return transport path Lb used when the paper T transported from upstream to downstream along the third transport path L3 is reversed and returned to the first transport path L1.

A first meeting point P1 and a second meeting point P2 are disposed in the first transport path L1. A first branch point Q1 is disposed in the third transport path L3.

A paper detection sensor (not illustrated) for detecting the paper T and the pair of registration rollers 80 for correcting a skew of the paper T (obliquely feeding) and for matching timing of formation of a toner image in the image forming portion GK and that of transport of the paper T are arranged in the first transport path L1 (more specifically, between the second meeting point P2 and the secondary transfer nip N2).

A pair of intermediate rollers 82 are arranged between the first meeting point P1 and the second meeting point P2 in the first transport path L1. The pair of intermediate rollers 82 are arranged downstream from the pair of paper feed rollers 81 in the transport direction of the paper T and transports the paper T transported by the pair of paper feed rollers 81 to the pair of registration rollers 80.

A directing member 58 is disposed at the first branch point Q1. The directing member 58 directs the paper T conveyed from the fixing device 9 and transported from upstream to downstream along the third transport path L3 toward the paper ejection portion 50 and also directs the paper T transported from downstream to upstream along the third transport path L3 toward the return transport path Lb.

The paper ejection portion 50 is disposed at an end of the third transport path L3 in the transport direction of the paper T. The paper ejection portion 50 is arranged in the upper part of the apparatus main body M. The paper ejection portion 50 ejects the paper T outside the apparatus main body M.

An ejected paper accumulating portion M1 is disposed in the vicinity of an opening of the paper ejection portion 50. The ejected paper accumulating portion M1 is disposed on the upper surface (outer surface) of the apparatus main body M. A paper detection sensor is arranged at a predetermined position in each transport path.

Next, a structure for removing a paper jam occurring in the first transport path L1, the second transport path L2, and the third transport path L3 (hereinafter, sometimes referred to collectively as "main transport path L1 to L3") is described briefly.

As illustrated in FIG. 1, the main transport path L1 to L3 and the return transport path Lb extend principally in a substantially vertical direction substantially in parallel with each other in a left side (the left in FIG. 1) of the apparatus main body M. The cover member 40 forming a part of the left side of the apparatus main body M is disposed in the left side (the left in FIG. 1) of the apparatus main body M. The cover member 40 is coupled to the apparatus main body M at its lower end with a pivotal shaft 43. The pivotal shaft 43 is arranged such that its axial direction extends in a direction that traverses the main transport path L1 to L3 and the return transport path Lb. The cover member 40 is movable between a closed position (position illustrated in FIG. 1) and an opened position (position illustrated in FIG. 2) about the pivotal shaft 43.

The cover member 40 includes a first cover portion 41 coupled to the apparatus main body M so as to be able to pivot about the pivotal shaft 43 and a second cover portion 42 coupled to the apparatus main body M so as to be able to pivot about the same pivotal shaft 43. The first cover portion 41 is closer to the outside of the apparatus main body M than the second cover portion 42.

The cover member 40 having the above-described configuration enables the printer 1 according to the present illustrative embodiment to provide for the paper T that may be causing a paper jam in the main transport path L1 to L3 to be removed by causing the cover member 40 to pivot from the closed position illustrated in FIG. 1 to the opened position illustrated in FIG. 2 and thus opening the main transport path L1 to L3.

The cover member 40 having the above-described configuration enables the printer 1 according to the illustrative embodiment to provide for attaching and detaching a fixing rotator unit 910 of the fixing device 9 (described below) to and from the apparatus main body M. The attaching and detaching structure and the attaching and detaching operation of the fixing device 9 are described in detail below, in accordance with some embodiments.

Figure 3:
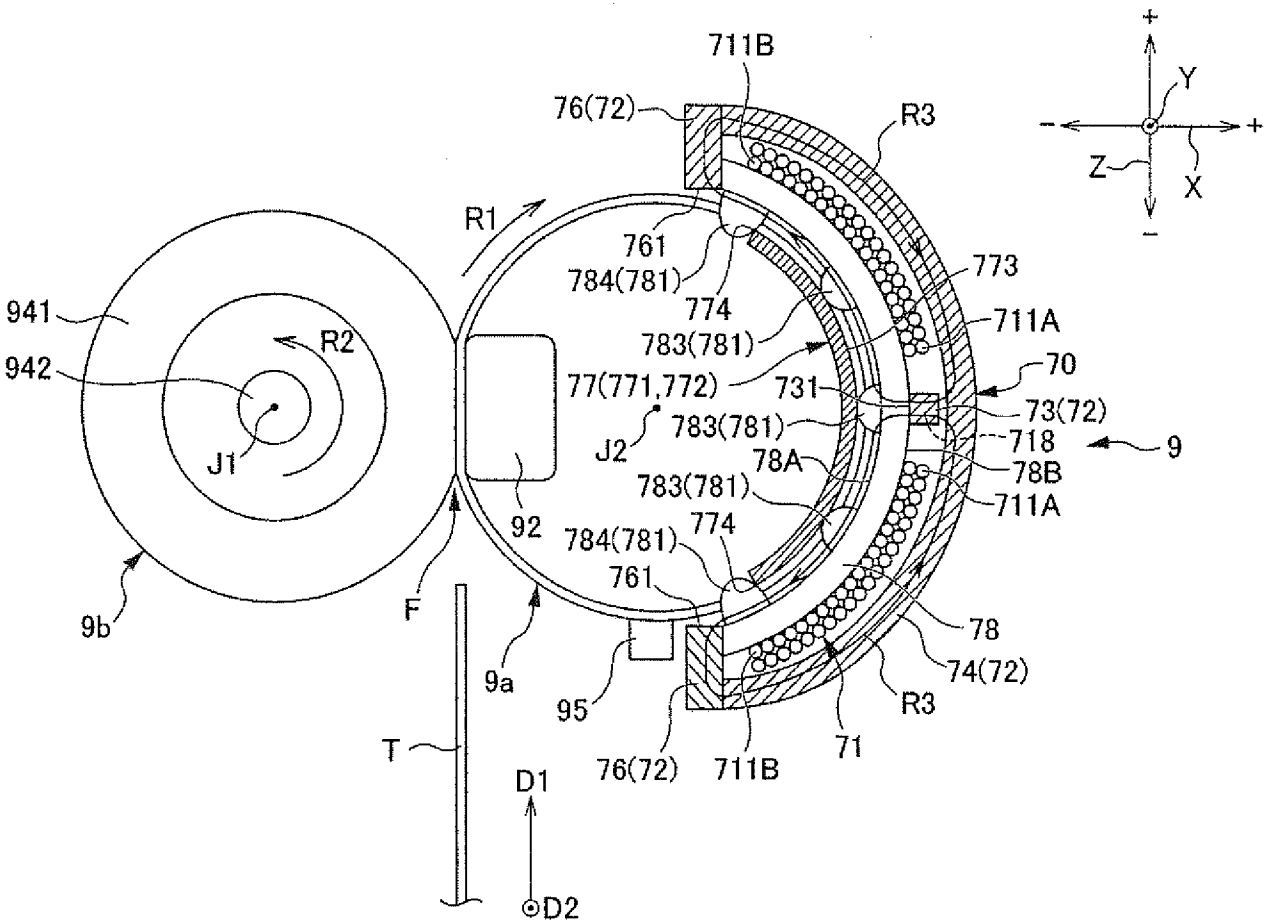
FIG. 3 is a cross-sectional view for describing components of a fixing device in the printer according to an embodiment.
Figure 4:
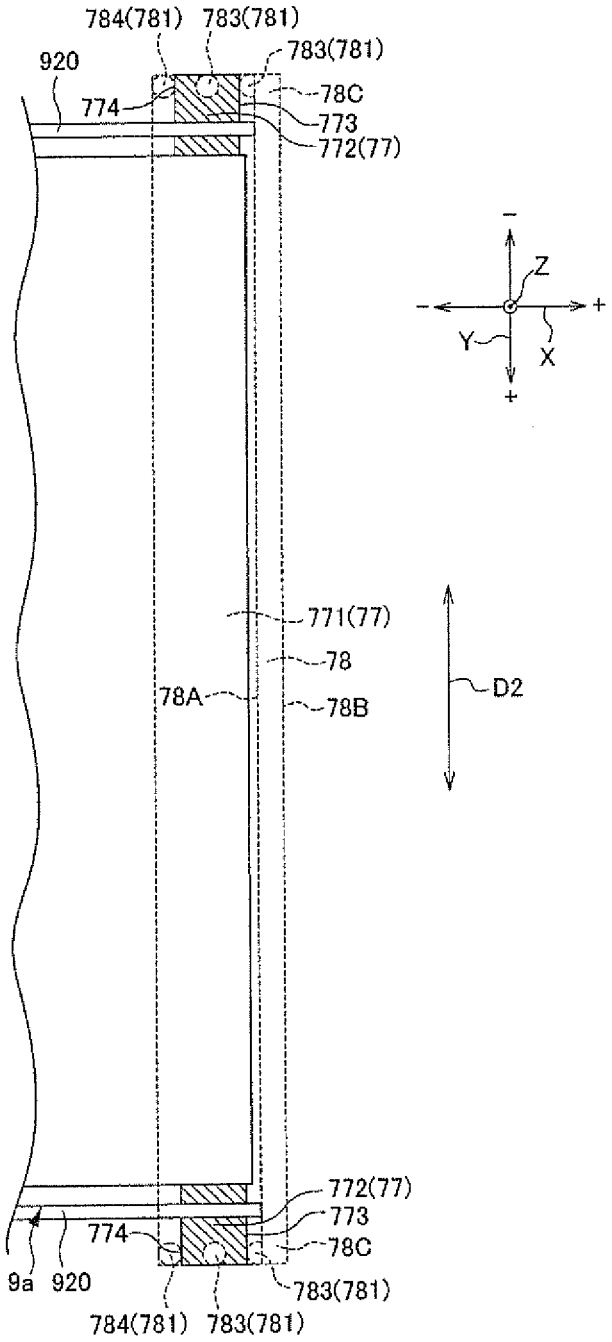
FIG. 4 depicts the fixing device illustrated in FIG. 3 as seen from the transport direction of paper.

Next, the configuration relating to the fixing device 9 being a feature of the printer 1 according to an embodiment is described in detail. FIG. 3 is a cross-sectional view for describing components of the fixing device 9 in the printer 1 according to the illustrative embodiment. FIG. 4 depicts the fixing device 9 illustrated in FIG. 3 as seen from the transport direction D1 of the paper T.

In the printer 1 according to the present embodiment, for ease of reference and clarity of exposition, the direction of the rotation axis of each of the photosensitive drums 2*a*, 2*b*, 2*c*, and 2*d* and each of the rotators (roller, belt, and the like) of the fixing device 9 and the like is referred to as "Y direction" (the direction penetrating FIG. 1). The Y direction is also the paper width direction D2 substantially perpendicular to the transport direction D1 of the paper T. In the Y direction, the front side is also referred to as "plus (+) side" and the rear side is also referred to as "minus (−) side." The substantially horizontal direction substantially perpendicular to the Y direction is referred to as "X direction." In the X direction, the right side is also referred to as "plus (+) side" and the left side is also referred to as "minus (−) side." The substantially vertical direction is referred to as Z direction (this is also the direction substantially perpendicular to both the X direction and Y direction). In the Z direction, the upper side is also referred to as "plus (+) side" and the lower side is also referred to as "minus (−) side."

As illustrated in FIG. 3, the fixing device 9 includes a heating rotary belt 9*a*, a pressurizing rotator 9*b* pressed against (made to come into contact with) the heating rotary belt 9*a*, an induction heating portion 70, a pressing member 92, a belt guide member 77, and a plurality of temperature sensors 95.

The heating rotary belt 9*a* has an annular shape (endless belt shape). The heating rotary belt 9*a* is a belt preferably having small thermal capacity in accordance with some embodiments. The heating rotary belt 9*a* can rotate about the second rotation axis J2 substantially parallel with the paper width direction D2 in a first circumferential direction R1. For the present embodiment, the direction D2 substantially perpendicular to the first circumferential direction R1 is also referred to as "paper width direction D2." The heating rotary belt 9*a* generates heat by induction heating employing electromagnetic induction by the use of the induction heating portion 70, which is described below.

The pressing member 92, which is described below, and the belt guide member 77, which is described below, are arranged inside the heating rotary belt 9*a*. The heating rotary belt 9*a* under a predetermined tension is stretched around the belt guide member 77 and the pressing member 92.

The pressing member 92 is in contact with the inner circumferential surface (inner surface) of the heating rotary belt 9*a* at a side of the pressurizing rotator 9*b* (pressing member 92 being disposed towards the minus side in the X direction inside the heating rotary belt 9*a*), and the belt guide member 77 is in contact with the inner circumferential surface (inner surface) of the heating rotary belt 9*a* at a side of a central core portion 73 (belt guide member 77 being disposed towards the plus side in the X direction inside the heating rotary belt 9*a*). The pressing member 92 and the belt guide member 77 according to some embodiments are described below.

The heating rotary belt 9*a* includes a magnetic metal layer as a first heat generation layer. The magnetic metal layer is made of a ferromagnetic material, such as electroformed nickel. An eddy current (an induced current) occurs in the magnetic metal layer of the heating rotary belt 9*a* by electromagnetic induction caused by a magnetic flux that does not penetrate (i.e., pass entirely through) the magnetic metal layer of the heating rotary belt 9*a* and that travels in the magnetic metal layer of the heating rotary belt 9*a*. The eddy current causes Joule heating to occur in the magnetic metal layer of the heating rotary belt 9*a* by electrical resistance of the magnetic metal layer of the heating rotary belt 9*a*. The heating rotary belt 9*a* also includes a silicone rubber elastic layer on the outer circumferential surface of the magnetic metal layer. The heating rotary belt 9*a* further includes a release layer on the outer circumferential surface of the elastic layer. The release layer is made of a heat-resistant film made of fluorocarbon resin, such as tetrafluoroethylene-perfluoroalkyl vinyl ether copolymer (PFA) or polytetrafluoroethylene (PTFE).

The heating rotary belt 9*a* is arranged in a region through which a magnetic flux generated by an induction coil 71 of the induction heating portion 70, which is described below, passes and thus forms a magnetic path for the magnetic flux generated by the induction coil 71 of the induction heating portion 70.

The pressurizing roller 9*b* as the pressurizing rotator has a substantially cylindrical shape (annular shape). The pressurizing roller 9*b* is arranged so as to face the heating rotary belt 9*a* on the minus side in the X direction seen from the heating rotary belt 9*a*. The pressurizing roller 9*b* can rotate about the first rotation axis J1 substantially parallel with the paper width direction D2 in a second circumferential direction R2. The pressurizing roller 9*b* is long in the direction of the first rotation axis J1.

The pressurizing roller 9*b* is arranged such that its outer circumferential surface is in contact with the outer circumferential surface (outer surface) of the heating rotary belt 9*a*. The pressurizing roller 9*b* is arranged so as to press the pressing member 92 (described below) through the heating rotary belt 9*a*. The pressurizing roller 9*b* and the pressing member 92 sandwich a part of the heating rotary belt 9*a* therebetween and form a fixing nip F between the heating rotary belt 9*a* and the pressurizing roller 9*b*. The paper T is sandwiched and transported at the fixing nip F.

The pressurizing roller 9*b* includes a pressuring-roller main body 941 and a pair of shaft members 942 coaxial with the first rotation axis J1. The pressuring-roller main body 941 includes a cored bar member having a substantially cylindrical shape, an elastic layer on the outer circumferential surface of the cored bar member, and a release layer on the outer circumferential surface of the elastic layer.

One of the shaft members 942 of the pressurizing roller 9*b* is connected to a rotation driving portion (not illustrated) for driving the pressurizing roller 9*b* so as to rotate. The rotation driving portion causes the pressurizing roller 9*b* to rotate at a predetermined speed and causes the heating rotary belt 9*a* being in contact with the outer circumferential surface of the pressurizing roller 9*b* to rotate so as to follow the rotation of the pressurizing roller 9*b*.

The pressing member 92 is arranged inside the heating rotary belt 9*a*. The pressing member 92 is in contact with the inner circumferential surface of the heating rotary belt 9*a* at a side of the pressurizing roller 9*b* inside the heating rotary belt 9*a* and presses the heating rotary belt 9*a* against the pressurizing roller 9*b*. For the present embodiment, iron or stainless steel (SUS) is used as the material of the pressing member 92.

The pressing member 92 is long in the paper width direction D2 and is secured. The pressing member 92 and the pressurizing roller 9*b* sandwich the heating rotary belt 9*a* therebetween and form the fixing nip F between the heating rotary belt 9*a* and the pressurizing roller 9*b*. The pressing member 92 is in contact with the inner circumferential surface of the heating rotary belt 9*a* while sliding thereon.

When the paper T transported to the fixing nip F passes within a paper passage area of the fixing device 9, a toner image is fixed on the paper T. Here, the "paper passage area" is an area where the paper T transported to the fixing nip F passes through while being sandwiched between the heating rotary belt 9*a* and the pressurizing roller 9*b*. An area that is outside the paper passage area for the paper T transported to the fixing nip F and through which no paper T passes is also referred to as "paper non-passage area."

The induction heating portion 70 according to some embodiments is described here. As illustrated in FIG. 3, the induction heating portion 70 includes the induction coil 71 as a magnetic-flux generating portion, a magnetic core portion 72, a support member 78 as a support portion, and a positioning portion 781.

The induction coil 71 is spaced away from the outer circumferential surface of the heating rotary belt 9*a* by a predetermined distance and is arranged along the outer circumferential surface of the heating rotary belt 9*a*. The induction coil 71 is made of wires which are wound in a long shape in the paper width direction D2 as seen from the plus side in the X direction in FIG. 3. The length of the induction coil 71 in the paper width direction D2 is longer than the length of the heating rotary belt 9*a*.

The induction coil 71 is formed such that copper litz wire is wound so as to surround a central area 718 extending in the paper width direction D2. The induction coil 71 is arranged so as to face a substantially half of the outer circumferential surface of the heating rotary belt 9*a* on the plus side in the X direction. The induction coil 71, wound in advance, is arranged in the induction heating portion 70 such that its longitudinal direction is substantially parallel with the paper width direction D2.

The support member 78 supports the induction coil 71. The support member 78 faces the heating rotary belt 9*a* on the plus side in the X direction and is spaced away from the heating rotary belt 9*a*. The support member 78 is secured to a pair of side core portions 76 of the magnetic core portion 72.

As illustrated in FIG. 4, the support member 78 is long in the paper width direction D2 and has a length substantially equal to the length of the induction coil 71 in the paper width direction D2.

The support member 78 is an arc-shaped plate member as seen from the paper width direction D2. The support member 78 includes an inner arc surface 78A adjacent to the heating rotary belt 9*a* and an outer arc surface 78B opposite to the heating rotary belt 9*a*. The induction coil 71 is arranged on the outer arc surface 78B of the support member 78. The support member 78 can be made of a heat-resistant resin material, for example.

The positioning portions 781 are integral with the support member 78 in the vicinity of both ends 78C of the support member 78 in the paper width direction D2. The positioning portions 781 position the belt guide member 77 such that the distance between the induction coil 71 and the outer circumferential surface of the heating rotary belt 9*a* is uniform.

As illustrated in FIG. 3, the positioning portions 781 include a plurality of ribs projecting from the inner arc surface 78A of the support member 78 toward the outer circumferential surface of the heating rotary belt 9*a*. For the present embodiment, the positioning portions 781 include three first ribs 783 as a contact portion and two second ribs 784 as an engaging portion at each of both ends of the support member 78 in the paper width direction D2. The second ribs 784 are disposed at an upstream side end and a downstream side end of the support member 78 in the first circumferential direction R1. The three first ribs 783 are spaced away from each other by predetermined distances between the second ribs 784.

The first ribs 783 are integral with the support member 78. Each of the second ribs 784 is an elastic member made of a heat-resistant elastic member, such as silicone rubber, that is bonded to the support member 78 by heat-resistant adhesive, for example. Alternatively, the second rib 784 may be a heat-resistant resin member that is connected to the support member 78 by an elastic member (not illustrated), such as a spring, and that is similar to the material of the support member 78.

The induction coil 71 is connected to an induction heating circuit portion (not illustrated). An alternating current is applied from the induction heating circuit portion to the induction coil 71. The application of the alternating current from the induction heating circuit portion causes the induction coil 71 to generate a magnetic flux for making the magnetic metal layer (first heat generating layer) of the heating rotary belt 9*a* generate heat. For example, an alternating current having a frequency of approximately 30 kHz is applied to the induction coil 71.

The magnetic flux generated by the induction coil 71 is guided to the magnetic path being the path for the magnetic flux formed by the heating rotary belt 9*a* and the magnetic core portion 72 (described below).

The magnetic path is formed by the heating rotary belt 9*a* and the magnetic core portion 72 (described below) such that the magnetic flux generated by the induction coil 71 circles in the circling direction R3. The circling direction R3 is the direction that circles so as to pass inside an inner edge 711A and outside an outer edge 711B of the induction coil 71 and that surrounds the wire portion of the induction coil 71. The magnetic flux generated by the induction coil 71 passes through the magnetic path.

Because an alternating current is applied from the induction heating circuit portion (not illustrated) to the induction coil 71, the magnitude and direction of the magnetic flux generated by the induction coil 71 are changed by periodic changes between the plus and minus sides of the alternating current. The periodic changes in the magnetic flux cause an induced current (an eddy current) to occur in the magnetic metal layer of heating rotary belt 9*a*.

As illustrated in FIG. 3, the magnetic core portion 72 forms the magnetic path that circles in the circling direction R3. Because the magnetic core portion 72 is arranged in an area in which a magnetic flux generated by the induction coil 71 passes and is principally composed of a ferromagnetic material, the magnetic core portion 72 forms the magnetic path being the path for the magnetic flux generated by the induction coil 71.

The magnetic core portion 72 includes the central core portion 73, a plurality of arch core portions 74, and the pair of side core portions 76.

The central core portion 73 is arranged in a substantially central location of the heating rotary belt 9*a* in the transport direction D1 of the paper T on the plus side in the X direction of the heating rotary belt 9*a* as seen in the paper width direction D2.

The central core portion 73 forms the magnetic path between the arch core portions 74 and the heating rotary belt 9*a* in the circling direction R3 of the magnetic path. The central core portion 73 is arranged in the vicinity of the central area 718 (in the vicinity of the inner edge 711A of the induction coil 71).

The central core portion 73 is spaced away from the outer circumferential surface of the heating rotary belt 9*a* by a predetermined distance and faces the outer circumferential surface of the heating rotary belt 9*a*. The central core portion 73 includes a first facing surface 731 facing the outer circumferential surface of the heating rotary belt 9*a* such that the induction coil 71 is not disposed therebetween.

The central core portion 73 has a substantially rectangular parallelepiped shape that is long in the paper width direction D2. The central core portion 73 is longer than an area that corresponds to the maximum paper passage area in the paper width direction D2.

The plurality of arch core portions 74 face the outer circumferential surface of the heating rotary belt 9*a* such that the induction coil 71 is disposed therebetween. Each of the plurality of arch core portions 74 has an arch shape extending along the circumferential direction of the heating rotary belt 9*a*. The plurality of arch core portions 74 form the magnetic paths opposite to the heating rotary belt 9*a* with respect to the induction coil 71 (outside the induction coil 71) in the circling direction R3 of the magnetic path.

The plurality of arch core portions 74 are spaced away from each other by a predetermined distance in the paper width direction D2. The plurality of arch core portions 74 form a plurality of magnetic paths that circle in the circling direction R3 and that are spaced away from each other in the paper width direction D2.

The pair of side core portions 76 form a magnetic path between the heating rotary belt 9*a* and each of the plurality of arch core portions 74 in the circling direction R3 of the magnetic path. The pair of side core portions 76 are arranged alongside each of the plurality of arch core portions 74 in the circling direction R3 of the magnetic path.

The pair of side core portions 76 are arranged in the vicinity of the outer edge 711B of the induction coil 71. The pair of side core portions 76 are spaced away from the outer circumferential surface of the heating rotary belt 9*a* by a predetermined distance and face the outer circumferential surface of the heating rotary belt 9*a*. Each of the pair of side core portions 76 includes a second facing surface 761 that faces the outer circumferential surface of the heating rotary belt 9*a* such that the induction coil 71 is not disposed therebetween.

Each of the pair of side core portions 76 has a substantially rectangular parallelepiped shape that is long in the paper width direction D2.

Each of the pair of side core portions 76 is longer than an area that corresponds to the maximum paper passage area in the paper width direction D2.

The belt guide member 77 in accordance with some embodiments is described here.

The belt guide member 77 is arranged in the inner space of the heating rotary belt 9*a*. The belt guide member 77 has an arc-shaped cross section seen in the paper width direction D2, as illustrated in FIG. 3, and is long in the paper width direction D2, as illustrated in FIG. 4. The belt guide member 77 is made of a rigid material, for example, a non-magnetic metal material, such as SUS 304, that has a thickness of, for example, approximately 0.2 to 0.5 mm.

As illustrated in FIG. 4, the belt guide member 77 is supported by side plates 920 coupled to coupling members 911 (described below) of the fixing rotator unit 910 (described below) so as to be able to move in the X direction. The belt guide member 77 is supported by the side plates 920 at locations inside both ends thereof by a predetermined distance.

The belt guide member 77 is in contact with a substantially one-third of the inner circumferential surface of the heating rotary belt 9*a* on the plus side in the X direction. The belt guide member 77 positions the heating rotary belt 9*a* with respect to the induction coil 71 and guides rotation of the heating rotary belt 9*a* about the second rotation axis J2.

As illustrated in FIGS. 3 and 4, the belt guide member 77 includes a guide portion 771 and extending portions 722. The guide portion 771 is a substantially central portion of the belt guide member 77 in the paper width direction D2. The guide portion 771 is arranged inside the heating rotary belt 9*a* so as to face the induction coil 71 such that the heating rotary belt 9*a* is disposed therebetween, and is in contact with the inner circumferential surface of the heating rotary belt 9*a*.

The extending portions 772 extend from both ends of the guide portion 771 in the paper width direction D2 outward in the paper width direction D2. The extending portions 772 face the support member 78 of the induction heating portion 70 such that the heating rotary belt 9*a* is not disposed therebetween.

The extending portions 772 include facing surfaces 773 facing the support member 78 and engaged portions 774 at upstream and downstream ends of the extending portions 772 in the first circumferential direction R1. The facing surface 773 of each of the extending portions 772 is in contact with a spherical vertex of each of the three first ribs 783. The belt guide member 77 is positioned by the first ribs 783 being in contact with the facing surface 773 of the extending portion 772 such that the distance between the induction coil 71 and the outer circumferential surface of the heating rotary belt 9*a* is uniform.

Each of the engaged portion 774 of each of the extending portions 772 is engaged with the corresponding second rib 784. The belt guide member 77 is positioned by the second ribs 784 being engaged with the engaged portions 774 of the extending portions 772 such that the distance between the induction coil 71 and the outer circumferential surface of the heating rotary belt 9*a* is uniform. For example, the distance is substantially uniform such that the temperature is substantially even in the direction of the rotation axis of the heating rotary belt and/or different produced fixing devices have substantially the same heating efficiency and thus substantially the same rise times.

Each of the temperature sensors 95 detects a temperature of the outer circumferential surface of the heating rotary belt 9*a*. Each of the temperature sensors 95 is arranged in contact with the outer circumferential surface of the heating rotary belt 9*a*.

Figure 5A:
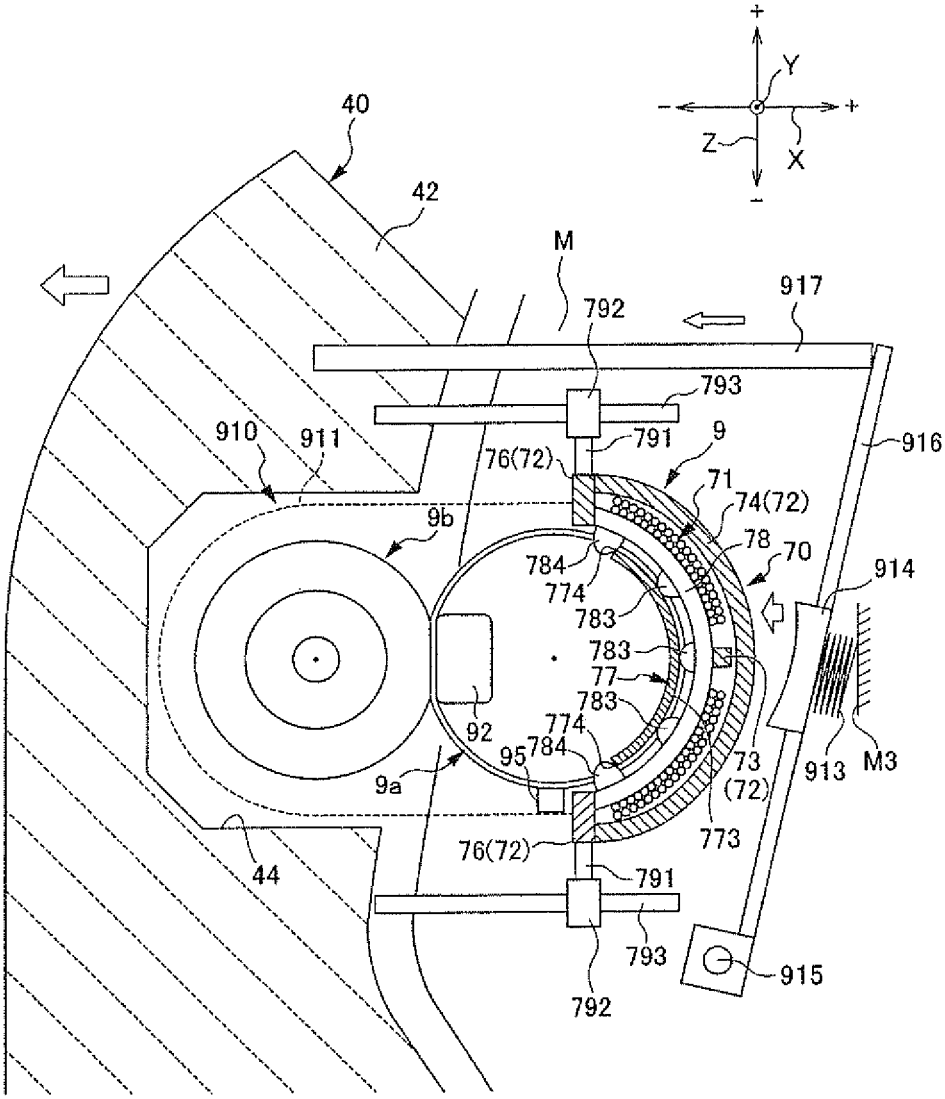
FIG. 5A is a cross-sectional view that illustrates a state in which the cover member is in a closed position when a fixing rotator unit is attached to an induction heating portion, in accordance with an embodiment.
Figure 5B:
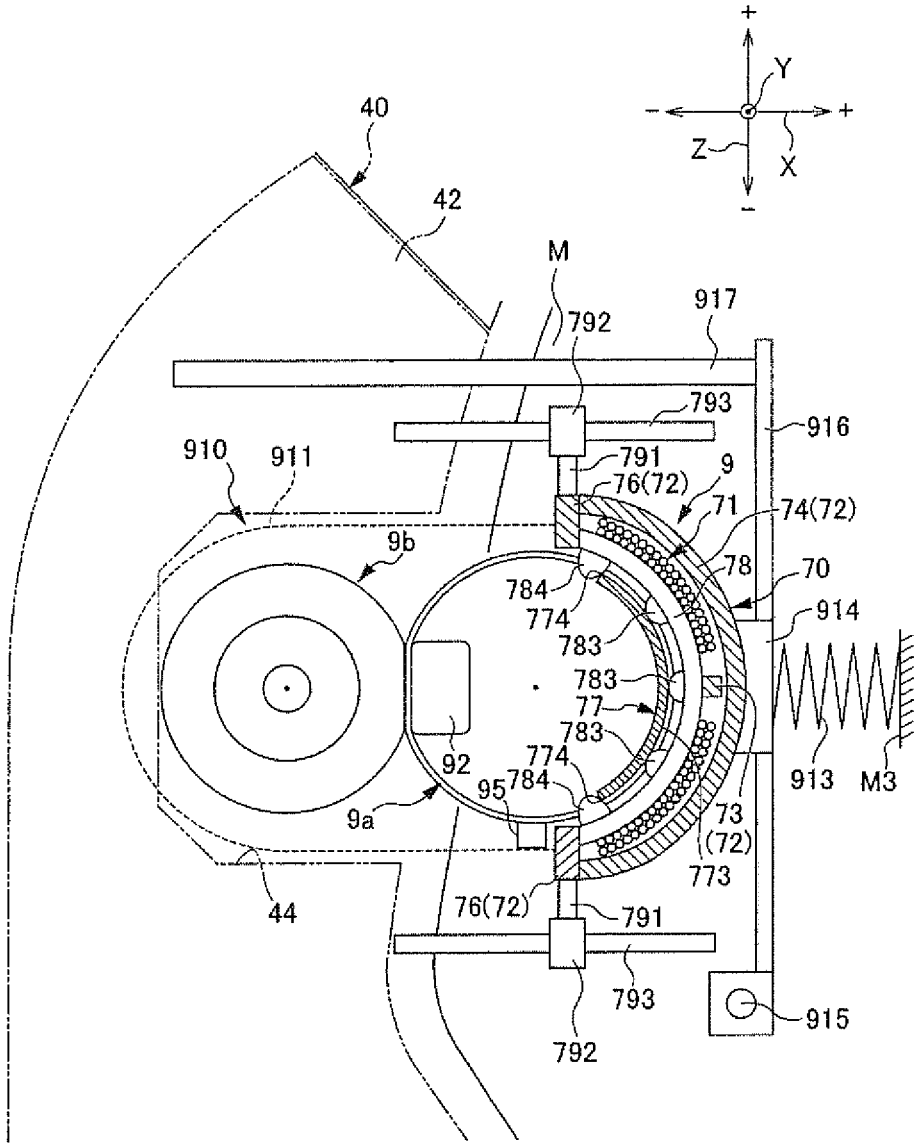
FIG. 5B is a cross-sectional view that illustrates a state in which the cover member is in an opened position shifting from the state illustrated in FIG. 5A when the fixing rotator unit is attached to the induction heating portion.
Figure 5C:
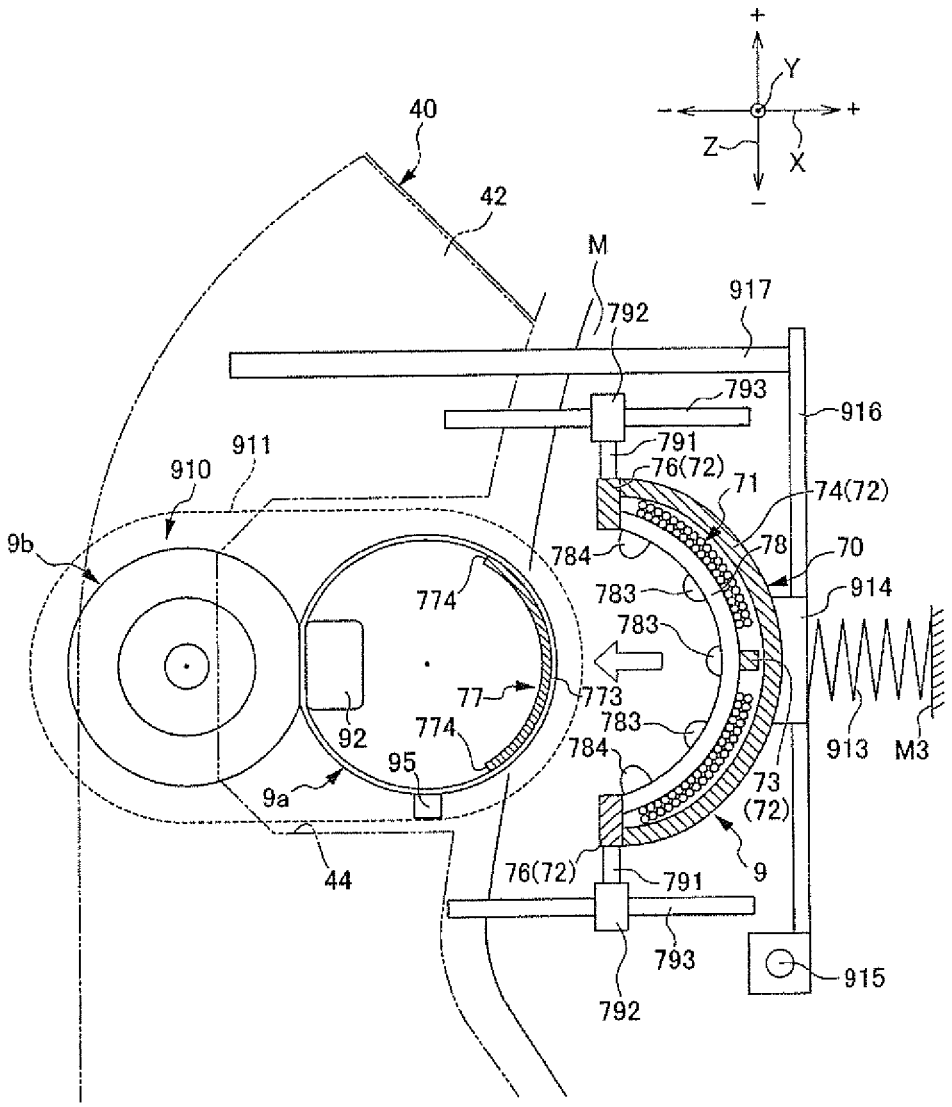
FIG. 5C is a cross-sectional view that illustrates a state in which the fixing rotator unit is detached from the induction heating portion shifting from the state illustrated in FIG. 5B.
Figure 6A:
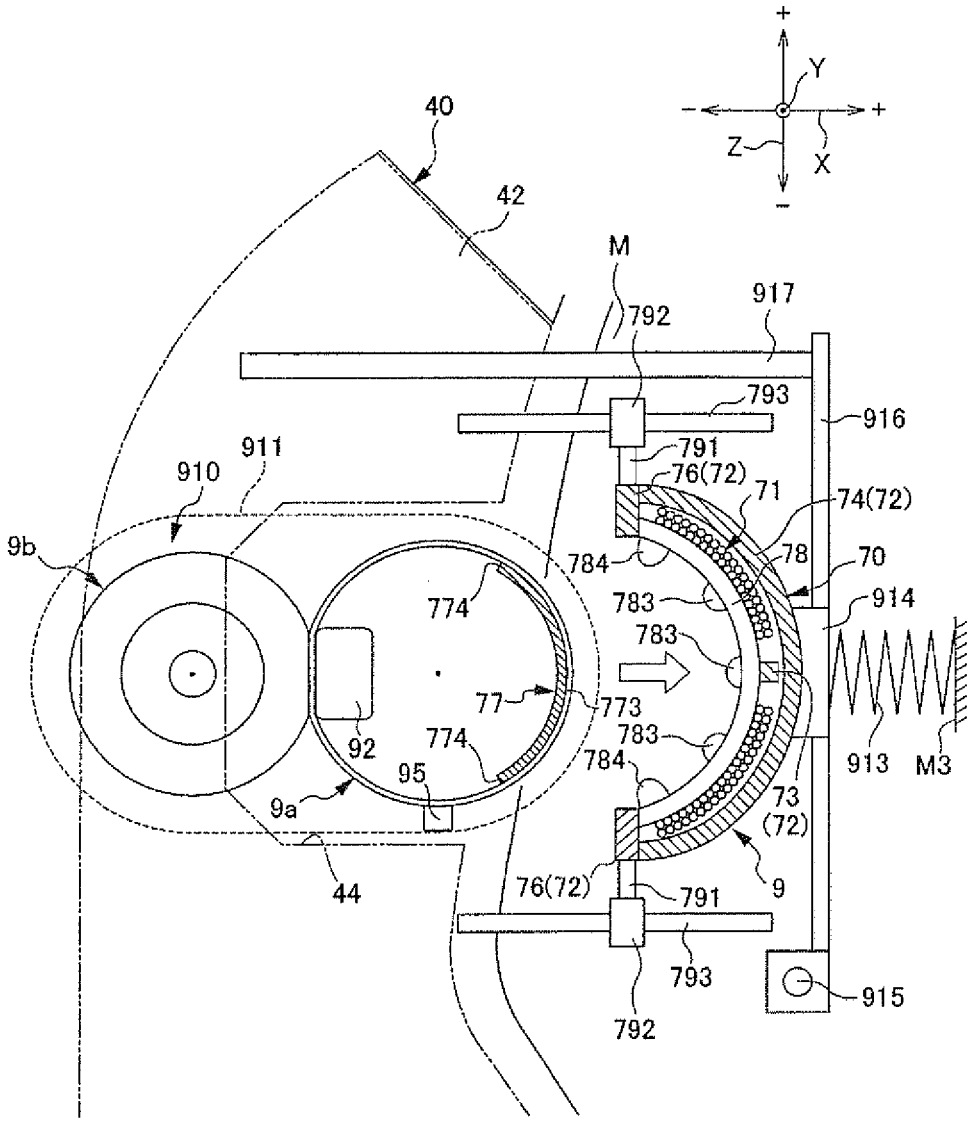
FIG. 6A is a cross-sectional view that illustrates a state in which the fixing rotator unit in the state illustrated in FIG. 5C is being attached to the induction heating portion.
Figure 6B:
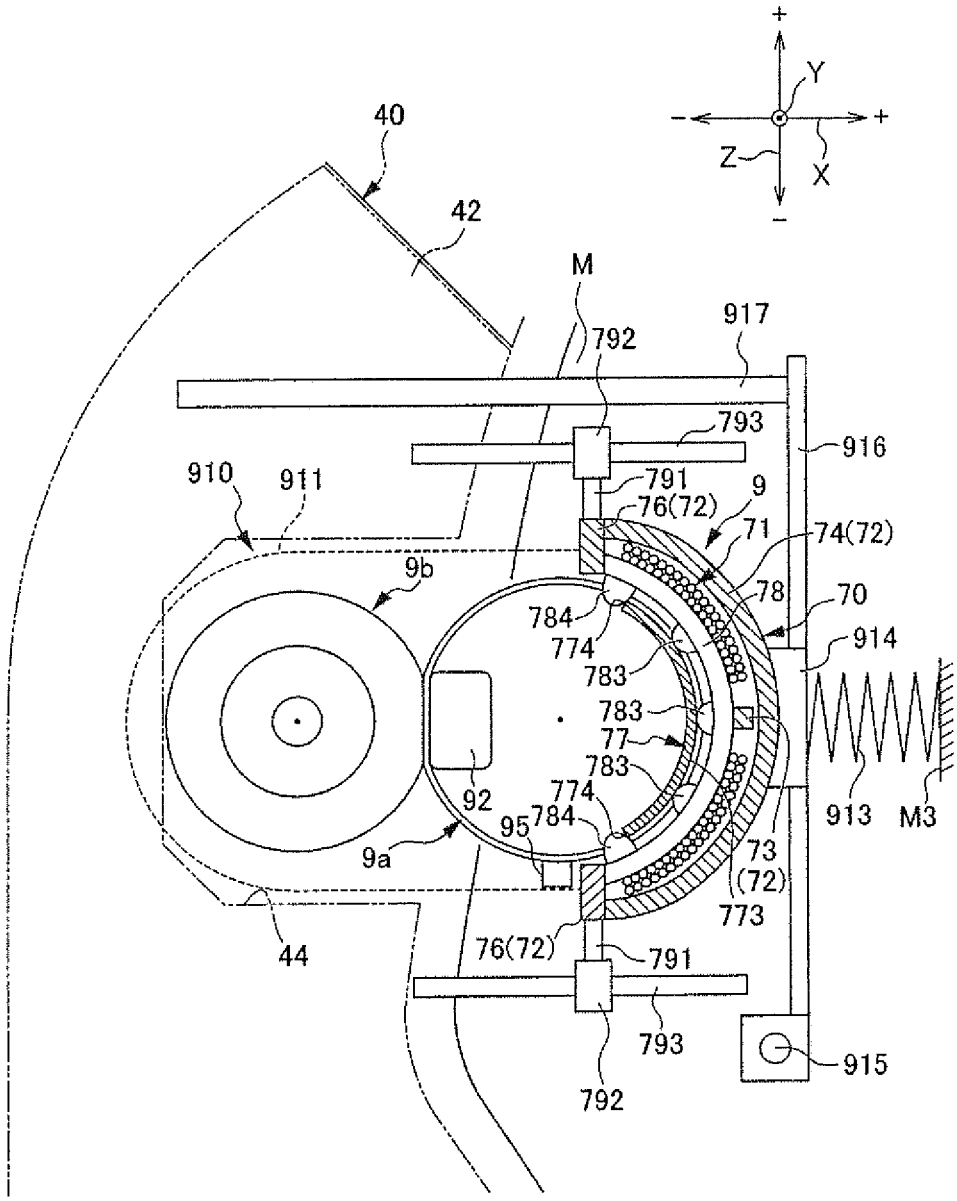
FIG. 6B is a cross-sectional view that illustrates a state in which the fixing rotator unit is attached to the induction heating portion shifting from the state illustrated in FIG. 6A.
Figure 6C:
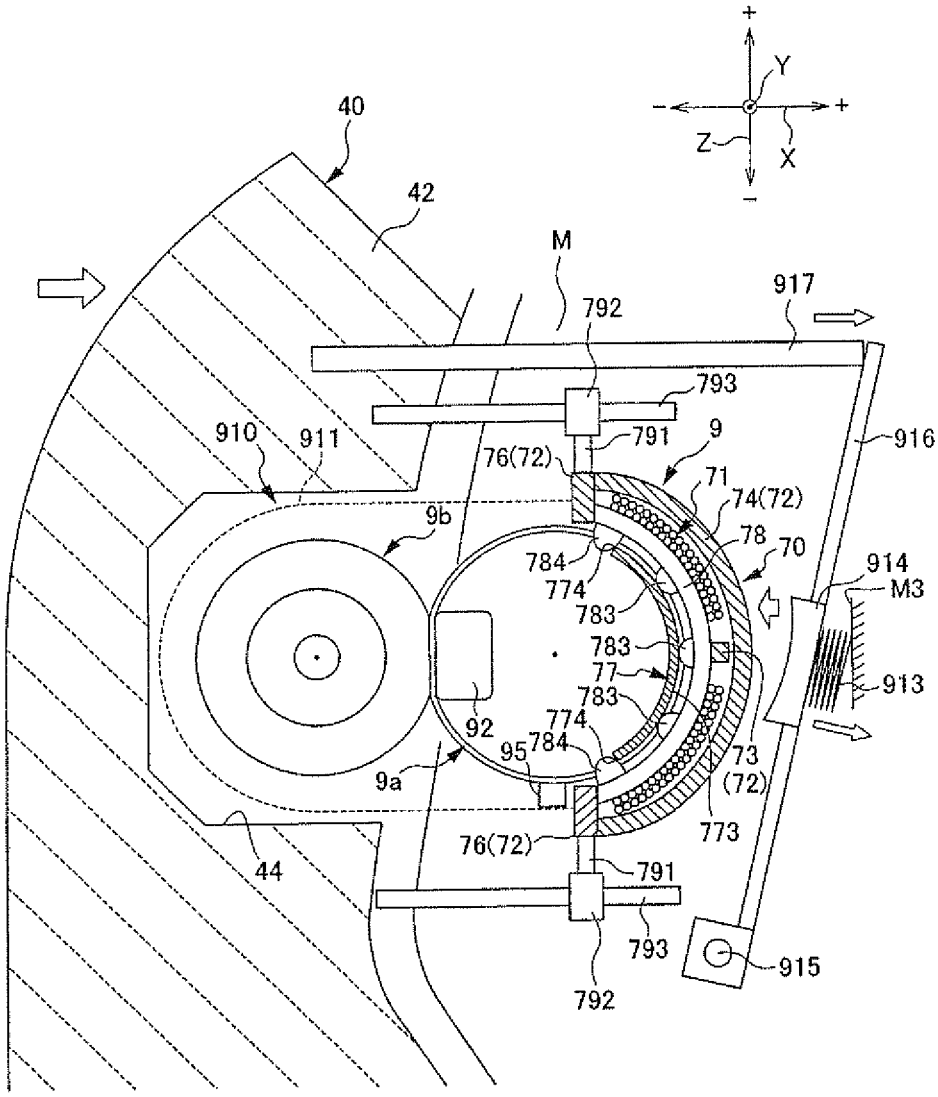
FIG. 6C is a cross-sectional view that illustrates a state in which the cover member is in the closed position shifting from the state illustrated in FIG. 6B when the fixing rotator unit is attached to the induction heating portion.

Next, the attaching and detaching structure of the fixing rotator unit 910 (described below) in the fixing device 9 is described, in accordance with some embodiments. FIG. 5A is a cross-sectional view that illustrates a state in which the cover member 40 is in the closed position when the fixing rotator unit 910 is attached to the induction heating portion 70. FIG. 5B is a cross-sectional view that illustrates a state in which the cover member 40 is in the opened position shifting from the state illustrated in FIG. 5A when the fixing rotator unit 910 is attached to the induction heating portion 70. FIG. 5C is a cross-sectional view that illustrates a state in which the fixing rotator unit 910 is detached from the induction heating portion 70 shifting from the state illustrated in FIG. 5B. FIG. 6A is a cross-sectional view that illustrates a state in which the fixing rotator unit 910 in the state illustrated in FIG. 5C is being attached to the induction heating portion 70. FIG. 6B is a cross-sectional view that illustrates a state in which the fixing rotator unit 910 is attached to the induction heating portion 70 shifting from the state illustrated in FIG. 6A. FIG. 6C is a cross-sectional view that illustrates a state in which the cover member 40 is in the closed position shifting from the state illustrated in FIG. 6B when the fixing rotator unit 910 is attached to the induction heating portion 70.

As illustrated in FIGS. 5A to 6C, the printer 1 includes the apparatus main body M as the main body of the image forming apparatus, the fixing device 9 arranged inside the apparatus main body M, and the cover member 40. The fixing device 9 includes the induction heating portion 70 and the fixing rotator unit 910.

The induction heating portion 70 includes the induction coil 71, the magnetic core portion 72, and the support member 78, as previously described. The induction heating portion 70 is attached to the apparatus main body M such that the position of the induction heating portion 70 is adjustable.

In the present embodiment, as illustrated in FIGS. 5A to 6C, the induction heating portion 70 can move in a substantially horizontal direction (X direction) while maintaining a predetermined attitude, and the position of the induction heating portion 70 in the X direction with respect to the apparatus main body M is adjustable.

The printer 1 includes a pair of stays 791, a pair of slide members 792, and a pair of rails 793, as the configuration that allows the induction heating portion 70 to move in the X direction. The pair of stays 791 extend from the pair of side core portions 76 upward and downward. The pair of slide members 792 are secured to the pair of stays 791. The pair of slide members 792 are coupled to the pair of rails 793 so as to be able to move along the pair of rails 793. The pair of rails 793 are linear and long in a substantially horizontal direction (X direction).

The fixing rotator unit 910 is a unit that includes the heating rotary belt 9*a*, the pressurizing roller 9*b*, the pressing member 92, and the belt guide member 77. In the fixing rotator unit 910, the shaft members 942 of the pressurizing roller 9*b* and the pressing member 92 are coupled to each other at both ends in the paper width direction D2 by the coupling members 911.

The fixing rotator unit 910 is attachable and detachable to and from the induction heating portion 70 attached to the apparatus main body M. The fixing rotator unit 910 is attached to the induction heating portion 70 in a state in which the second ribs 784 of the support member 78 are engaged with the engaged portions 774 of the belt guide member 77 and the first ribs 783 are in contact with the facing surfaces 773 of the belt guide member 77.

The cover member 40 can be opened to the opened position at which the fixing device 9 is exposed (see FIGS. 2, 5B, 5C, 6A, and 6B) and be closed to the closed position at which the fixing device 9 is covered (see FIGS. 1, 5A, and 6C) in a state in which the fixing device 9 is held in the apparatus main body M. The cover member 40 has a hollow 44 in the inner surface, and the hollow 44 receives the fixing device 9 when the cover member 40 is in the closed position. When the cover member 40 is in the opened position, because it is opened to the degree illustrated in FIG. 2 with respect to the apparatus main body M, the cover member 40 is not explicitly illustrated in FIGS. 5B, 5C, 6A, and 6B (instead, the cover member 40 in the closed position is shown in the chain double-dashed line).

The printer 1 includes an urging portion 913. The urging portion 913 is arranged between a core contact member 914, which can be swung, and a securing portion M3 of the apparatus main body M. In the present embodiment, the urging portion 913 is made of a coil spring.

The core contact member 914 is secured to an intermediate part of a swing arm 916. The core contact member 914 can be made to come into contact with a substantially central part of the outer surface of the arch core portions 74 by swinging of the swing arm 916. The swing arm 916 can swing in the +X direction and −X direction about a pivotal shaft 915 arranged below the induction heating portion 70 disposed inside the apparatus main body M. The upper end of the swing arm 916 is in contact with an extremity of a movable rod 917 moving in the +X direction and −X direction in conjunction with opening and closing of the cover member 40.

The movable rod 917 is moved in the +X direction in the apparatus main body M in conjunction with a closing operation of the cover member 40. With the movement of the movable rod 917, the extremity of the movable rod 917 presses the swing arm 916. This causes the swing arm 916 to swing about the pivotal shaft 915 in the +X direction. In conjunction with an opening operation of the cover member 40, pressing the swing arm 916 by the movable rod 917 is released. Thus the swing arm 916 is made to swing in the −X direction by the urging force of the urging portion 913 and moves the movable rod 917 while being in contact with the movable rod 917.

The core contact member 914 is moved to a contact position at which it is in contact with the outer surface of the arch core portions 74 and to a non-contact position at which it is spaced away from the outer surface of the arch core portions 74 by the swinging of the swing arm 916. The contact position of the core contact member 914 is the position where the urging force of the urging portion 913 is transmitted to the induction heating portion 70. The non-contact position of the core contact member 914 is the position where the urging force of the urging portion 913 is not transmitted to the induction heating portion 70.

As illustrated in FIG. 5B, when the core contact member 914 is in the contact position, the induction heating portion 70 is moved by the urging force of the urging portion 913 to a position distant from a predetermined reference position in the −X direction. The predetermined reference position is the reference position where the induction heating portion 70 is positioned when the fixing device 9 performs a fixing operation.

Next, operations of the printer 1, including the fixing device 9, according to the hereinabove described illustrative embodiment are described.

First, an accept portion (not illustrated) of the printer 1 accepts image forming instructing information generated in response to, for example, an operation on an operating portion (not illustrated) arranged outside the printer 1 when the power of the printer 1 is on.

Then, the printer 1 starts a printing operation.

Specifically, the paper T sent from the pair of registration rollers 80 passes along the first transport path L1 and is transported to the secondary transfer nip N2 between the intermediate transfer belt 7 and the secondary transfer roller 8. When the paper T is transported to the secondary transfer nip N2 in this way, first, the charging portions 10*a*, 10*b*, 10*c*, and 10*d* evenly charge the surfaces of the photosensitive drums 2*a*, 2*b*, 2*c*, and 2*d*, respectively, negatively (negative polarity) or positively (positive polarity). Then, the laser scanner units 4*a*, 4*b*, 4*c*, and 4*d* emit laser light to the photosensitive drums 2*a*, 2*b*, 2*c*, and 2*d*, respectively, from the laser light sources (not illustrated) for scanning and exposing the surfaces of the photosensitive drums 2*a*, 2*b*, 2*c*, and 2*d*, respectively. In this way, an electrostatic latent image is formed on the surface of each of the photosensitive drums 2*a*, 2*b*, 2*c*, and 2*d*.

Subsequently, the developing devices 16*a*, 16*b*, 16*c*, and 16*d* deposit toners of different colors on the electrostatic latent images on the surfaces of the photosensitive drums 2*a*, 2*b*, 2*c*, and 2*d*, respectively, to form toner images of different colors on the surfaces of the photosensitive drums 2*a*, 2*b*, 2*c*, and 2*d*, respectively. Then, the toner images of different colors on the surfaces of the photosensitive drums 2*a*, 2*b*, 2*c*, and 2*d* are primarily transferred to the intermediate transfer belt 7 in sequence. In this way, a full-color toner image is funned on the intermediate transfer belt 7.

Subsequently, the full-color toner image is transferred to the paper T passing through the secondary transfer nip N2 between the intermediate transfer belt 7 and the secondary transfer roller 8. The paper T with the toner image transferred thereon passes along the second transport path L2 and is transported toward the fixing device 9. Specifically, the paper T with the toner image transferred thereon is transported toward the fixing nip F between the heating rotary belt 9*a* and the pressurizing roller 9*b* of the fixing device 9.

Then, when supplying power to a driving control portion (not illustrated) of the fixing device 9 starts, the pressurizing roller 9*b* is driven so as to rotate by the rotation driving portion (not illustrated). The heating rotary belt 9*a* rotates so as to follow the rotation of the heating rotary belt 9*a*.

Next, the fixing device 9 starts an operation of generating heat. With this, an alternating current is applied from the induction heating circuit portion (not illustrated) to the induction coil 71. The induction coil 71 generates a magnetic flux for making the heating rotary belt 9*a* generate heat.

The magnetic flux generated by the induction coil 71 passes through the magnetic path formed by the heating rotary belt 9*a*, the central core portion 73, the plurality of arch core portions 74, and the pair of side core portions 76; that is, this magnetic flux circles around the wire forming the induction coil 71 in the circling direction R3 connecting the inside of the inner edge 711A and the outside of the outer edge 711B of the induction coil 71.

Changes in the magnitude and the direction of the magnetic flux passing through the magnetic path causes eddy current (induced current) by electromagnetic induction to occur in the magnetic metal layer (first heat generating layer) in the heating rotary belt 9*a*. The eddy current causes Joule heating to occur in the magnetic metal layer of the heating rotary belt 9*a* due to the electrical resistance of the magnetic metal layer of the heating rotary belt 9*a*, thus heating the heating rotary belt 9*a*.

Next, the rotation of the heating rotary belt 9*a* causes the part heated due to induction heating (magnetic metal layer) of the heating rotary belt 9*a* to be moved toward the fixing nip F formed between the heating rotary belt 9*a* and the pressurizing roller 9*b*. The printer 1 controls the induction heating circuit portion (not illustrated) such that a predetermined temperature is established at the fixing nip F.

Then, when the paper T with the toner image formed thereon is guided to the fixing nip F of the fixing device 9, the toner is fused at the fixing nip F and the toner is fixed on the paper T.

Here, as illustrated in FIG. 5A, in a state in which the fixing rotator unit 910 is attached to the induction heating portion 70, the cover member 40 is in the closed position. In this state, the core contact member 914 is spaced away from the arch core portions 74 and the urging force of the urging portion 913 is not transmitted to the induction heating portion 70.

Engagement of the engaged portions 774 with the second ribs 784 secures the induction heating portion 70 to the belt guide member 77, as the facing surfaces 773 comes into contact with the first ribs 783. This enables the belt guide member 77 to be positioned with respect to the induction coil 71 such that the distance between the induction coil 71 and the outer circumferential surface of the heating rotary belt 9*a* is uniform. As a result, variations in the heating efficiency of the heating rotary belt 9*a* can be reduced and the heating efficiency can be uniform. That is, the uniform heating efficiency of the heating rotary belt 9*a* in the paper width direction D2 can result in a homogeneous temperature distribution of the heating rotary belt 9*a* in the paper width direction D2. Also, the uniform heating efficiency achieved by reducing variations in the heating efficiency between produced fixing devices 9 can reduce variations in the temperature rise time at start-up of each of the produced fixing devices 9 and make the temperature rise time uniform.

The belt guide member 77 applies a predetermined tension to the heating rotary belt 9*a* toward the induction heating portion 70 in a state in which the engaged portions 774 of the extending portions 772 are engaged with the second ribs 784 of the positioning portions 781. This enables the heating rotary belt 9*a* to rotate stably. Accordingly, the fixing device 9 can stably perform a predetermined fixing operation.

The belt guide member 77 positions the course of rotation of the heating rotary belt 9*a* and also guides the rotation of the heating rotary belt 9*a*. Accordingly, the belt guide member 77 can stabilize the rotation of the heating rotary belt 9*a*.

Next, an operation of attaching and detaching the fixing rotator unit 910 of the fixing device 9 is described, in accordance with some embodiments.

First, an operation of removing (detaching) the fixing rotator unit 910 from the apparatus main body M is described.

The cover member 40 is moved from the closed position illustrated in FIG. 5A to the opened position illustrated in FIG. 5B. In this case, the swing arm 916 is made to swing about the pivotal shaft 915 toward the outside of the apparatus main body M (toward the cover member 40) due to the movement of the movable rod 917 in conjunction with the movement of the cover member 40. The core contact member 914 is made to come into contact with the arch core portions 74 by the urging force of the urging portion 913. Thus, the urging force of the urging portion 913 is transmitted to the induction heating portion 70. Therefore, the induction heating portion 70 is urged by the urging force of the urging portion 913 toward outside the apparatus main body M (toward the cover member 40) away from the predetermined reference position. Accordingly, because the fixing rotator unit 910 is located in a position closer to the cover member 40 than the predetermined reference position in the apparatus main body M, the fixing rotator unit 910 is located in a position at which it can be easily removed from the induction heating portion 70.

From the state illustrated in FIG. 5B, detaching the engaged portions 774 of the belt guide member 77 from the second ribs 784 of the support member 78 enables the fixing rotator unit 910 to be detached (removed) from the induction heating portion 70, as illustrated in FIG. 5C.

At this time, because the second ribs 784 having elasticity are pressed by the engaged portions 774 of the belt guide member 77, the second ribs 784 are thus temporarily deformed in the −X direction. And then, after the belt guide member 77 passes in contact with the second ribs 784, the second ribs 784 are returned to the original attitude due to their elasticity.

Next, an operation of attaching the fixing rotator unit 910 to the induction heating portion 70 is described, in accordance with some embodiments.

As illustrated in FIG. 6A, in a state in which the cover member 40 is in the opened position and the fixing rotator unit 910 is removed from the apparatus main body M, the induction heating portion 70 is located in the position closer to the cover member 40 than the predetermined reference position in the apparatus main body M. In this state, the fixing rotator unit 910 is attached to the induction heating portion 70. Because the induction heating portion 70 is located away from the reference position in the apparatus main body M, the fixing rotator unit 910 can be easily attached to the induction heating portion 70.

At this time, the second ribs 784 of the support member 78 having elasticity are pressed by the engaged portions 774 of the belt guide member 77, the second ribs 784 are thus temporarily deformed in the +X direction. And then, after the engaged portions 774 of the belt guide member 77 passes in contact with the second ribs 784, the second ribs 784 are returned to the original attitude by their elasticity. The second ribs 784 come into contact with the engaged portions 774 of the belt guide member 77, and thus the belt guide member 77 is engaged with the support member 78. The second ribs 784 urge the belt guide member 77 toward the support member 78 (induction heating portion 70) by their elasticity.

Then, as illustrated in FIG. 6B, the engaged portions 774 of the belt guide member 77 are engaged with the second ribs 784 of the support member 78, and the facing surfaces 773 of the belt guide member 77 are made to come into contact with the first ribs 783. This enables the belt guide member 77 to be positioned such that the distance between the induction coil 71 of the induction heating portion 70 and the outer circumferential surface of the heating rotary belt 9*a* is uniform.

Then, the cover member 40 is moved from the opened position illustrated in FIG. 6B to the closed position illustrated in FIG. 6C. As illustrated in FIG. 6C, the swing arm 916 is made to swing about the pivotal shaft 915 through the movable rod 917 toward the inside of the apparatus main body M (away from the cover member 40) in conjunction with the movement of the cover member 40. The core contact member 914 is made to become separated from the arch core portions 74 against the urging force of the urging portion 913, and the urging force of the urging portion 913 is not transmitted to the induction heating portion 70.

At this time, the fixing rotator unit 910 is pressed by the cover member 40 and is moved to the +X direction together with the induction heating portion 70. When the fixing rotator unit 910 reaches a predetermined position at which the fixing device 9 can fix an image on the paper T, the shaft members 942 of the pressurizing roller 9*b*, which is a component of the fixing rotator unit 910, is fit to bearings (not illustrated) of the apparatus main body M for positioning the shaft members 942. That is, the shaft members 942 of the pressurizing roller 9*b* are positioned at the positional reference for the fixing device 9.

As described above, the fixing rotator unit 910 is attachable to and detachable from the induction heating portion 70 attached to the apparatus main body M. Thus only the fixing rotator unit 910 can be removed from the apparatus main body M while the expensive and durable induction heating portion 70 remains at the apparatus main body M. Accordingly, the fixing rotator unit 910 can be replaced, repaired, and inspected easily.

The support member 78 includes the elastic second ribs 784 for enabling the belt guide member 77 to be engaged with the support member 78 (induction heating portion 70). Thus, the belt guide member 77 can be accurately positioned such that the distance between the induction coil 71 and the outer circumferential surface of the heating rotary belt 9*a* is uniform.

In a state in which the second ribs 784 are engaged with the engaged portions 774, the belt guide member 77 can be located in the predetermined reference position by the urging force of the elastic second ribs 784, and a predetermined tension can be applied to the heating rotary belt 9*a*. This can reduce variations in the heating efficiency of the fixing device 9 and can make the heating efficiency uniform by reducing deformation of the heating rotary belt 9*a*.

With the printer 1 according to the hereinabove described embodiment, illustrative advantageous effects that may be provided are described below.

The printer 1 according to the hereinabove described illustrative embodiment includes the positioning portions 781 at the induction heating portion 70 for coming into contact with or engaging the extending portions 772 of the belt guide member 77. Thus, the belt guide member 77 can be positioned by the positioning portions 781 coming into contact with or engaging the extending portions 772 such that the distance between the induction coil 71 and the outer circumferential surface of the heating rotary belt 9*a* is uniform. Accordingly, variations in the heating efficiency of the fixing device 9 can be reduced and the heating efficiency can be uniform. As a result, variations in the rise time of the fixing device 9 can be reduced and the rise time can be uniform (e.g., uniform with respect for different heating cycles of the same printer, as well as with respect to the heating cycles of different printers).

In a state in which the second ribs 784 of the induction heating portion 70 are engaged with the engaged portions 774 of the extending portions 772 of the belt guide member 77, the belt guide member 77 can be positioned. Thus, because the state of engagement between the second ribs 784 and the engaged portions 774 is maintained, the distance between the induction coil 71 and the outer circumferential surface of the heating rotary belt 9*a* can be stable. Accordingly, variations in the heating efficiency of the fixing device 9 can be further reduced and the heating efficiency can be uniform.

The distance between the facing surface 773 of each of the extending portions 772 and the support member 78 can be set by the use of the height of each of the first ribs 783 of the positioning portion 781. Thus, the belt guide member 77 can be positioned with a simple configuration. Accordingly, variations in the heating efficiency of the fixing device 9 can be further reduced and the heating efficiency can be uniform.

In the printer 1 according to the hereinabove described illustrative embodiment, the fixing rotator unit 910 is attachable to and detachable from the induction heating portion 70 attached to the apparatus main body M. Thus only the fixing rotator unit 910 can be removed from the apparatus main body M while the expensive and durable induction heating portion 70 remains at the apparatus main body M. Accordingly, the fixing rotator unit 910 can be replaced, repaired, and inspected easily.

The printer 1 according to the hereinabove described illustrative embodiment includes the second ribs 784 of the positioning portion 781 for urging the belt guide member 77 toward the induction heating portion 70 in a state in which the fixing rotator unit 910 is attached to the induction heating portion 70. This enables the belt guide member 77 to be accurately positioned with respect to the induction heating portion 70.

In a state in which the engaged portions 774 are engaged with the second ribs 784, a predetermined tension can be applied to the heating rotary belt 9*a* by the urging force of the second ribs 784. This can reduce variations in the heating efficiency of the fixing device 9 and can make the heating efficiency uniform by reducing deformation of the heating rotary belt 9*a*.

Next, an illustrative alternative embodiment of the present disclosure is described. For clarity of exposition, the following description concentrates on the differences from the hereinabove described embodiment, and the same reference numerals are used as in the hereinabove described embodiment for similar components and the description thereof is omitted.

Figure 7:
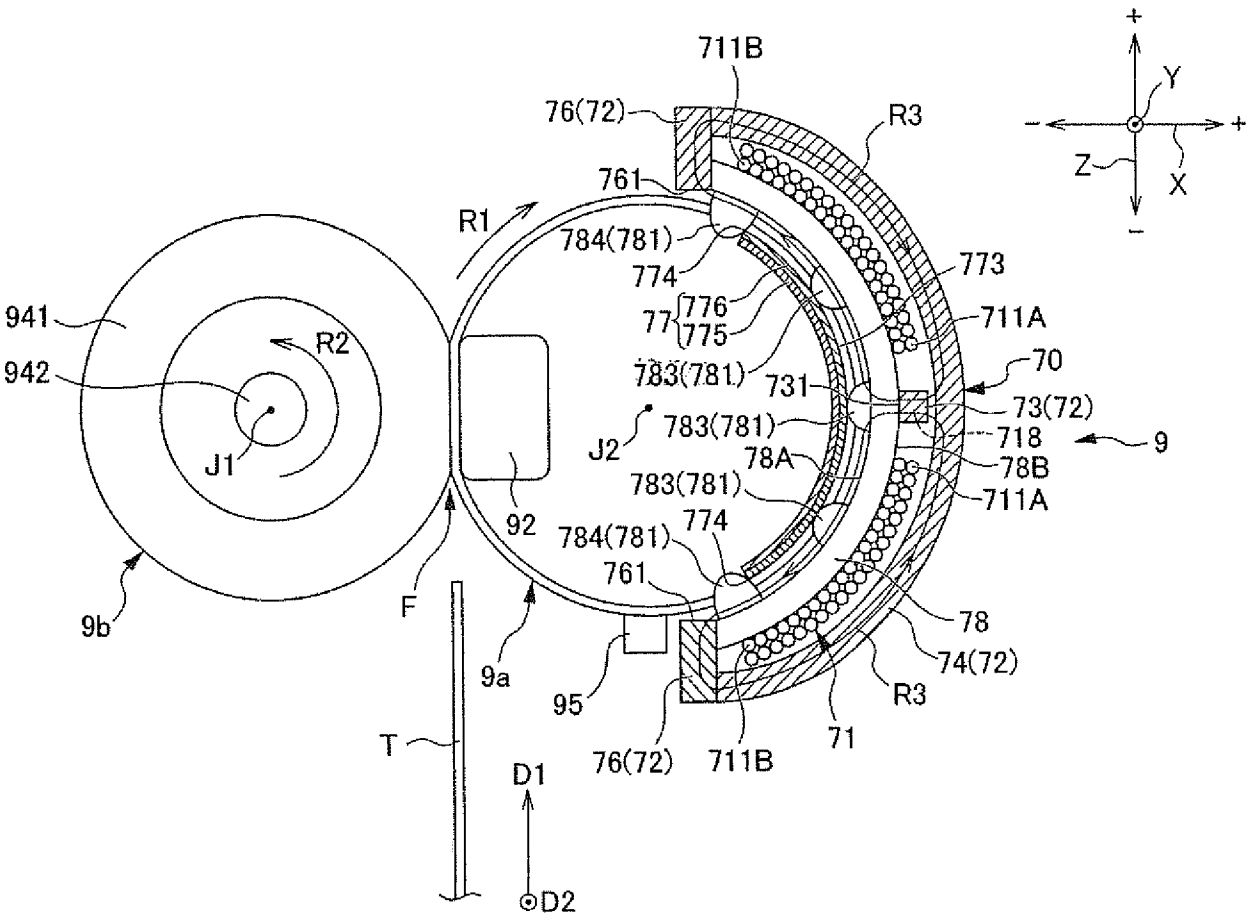
FIG. 7 is a cross-sectional view for describing components of a fixing device in a printer according to another embodiment of the present disclosure.

FIG. 7 is a cross-sectional view for describing components of the fixing device 9 of the printer 1 according to the illustrative alternative embodiment.

The heating rotary belt 9*a* according to the illustrative alternative embodiment principally includes the magnetic metal layer as the first heat generating layer. The magnetic metal layer is thinner than the skin depth (magnetic field penetration depth).

The belt guide member 77 according to the illustrative alternative embodiment includes a base layer 775 and a second heat generating layer 776 nearer to the heating rotary belt 9*a* than the base layer 775. A magnetic flux generated by the induction coil 71 causes the second heat generating layer 776 to generate heat. The base layer 775 is made of a non-magnetic metal material, such as SUS 304, and has a thickness of approximately 0.2 to 0.5 mm. The second heat generating layer 776 is made of a magnetic metal, such as nickel or SUS 403, and has a thickness of approximately 100 μm.

Because the magnetic metal layer of the heating rotary belt 9*a* is thinner than the skin depth, a part of the magnetic flux generated by the induction coil 71 penetrates (i.e., passes entirely through) the magnetic metal layer of the heating rotary belt 9*a*.

In the illustrative alternative embodiment, the thickness of the magnetic metal layer (first heat generating layer) of the heating rotary belt 9*a* is, for example, approximately 40 μm, whereas the skin depth is approximately 43.7 μm. Thus, approximately 50% of the magnetic flux generated by the induction coil 71 penetrates the heating rotary belt 9*a*.

In the fixing device 9 in the printer 1 according to the illustrative alternative embodiment, a part of the magnetic flux generated by the induction coil 71 penetrates the magnetic metal layer (first heat generating layer) of the heating rotary belt 9*a*, and the part of the magnetic flux that has penetrated the magnetic metal layer causes the second heat generating layer 776 of the belt guide member 77 to generate heat.

With the printer 1 according to the illustrative alternative embodiment illustrated in FIG. 7, some advantageous effects in addition to advantageous effects described with respect to the embodiment illustrated in FIG. 3 are described below.

In the fixing device 9 of the printer 1 according to the illustrative alternative embodiment, the magnetic metal layer (first heat generating layer) of the heating rotary belt 9*a* is thinner than the skin depth (magnetic field penetration depth). In addition, the belt guide member 77 includes the second heat generating layer 776. Thus, the magnetic flux generated by the induction coil 71 can cause the first heat generating layer of the heating rotary belt 9*a* and the second heat generating layer 776 of the belt guide member 77 to generate heat. This enables the heating rotary belt 9*a* to be efficiently heated. Accordingly, the rise time can be shorter than that of the fixing device 9 according to the embodiment described with reference to FIG. 3, and power consumption can be reduced.

The embodiments described above are merely illustrative. The present disclosure is not limited to the foregoing embodiments and can be made in various forms.

For example, in the embodiment described above with reference to FIG. 3 (among other figures), the urging portion 913 is made of a coil spring. Alternatively, other urging members, including publicly known ones, can also be used.

For the embodiment illustrated in FIG. 7, the second heat generating layer 776 made to generate heat by a magnetic flux passing through the heating rotary belt 9*a* is described. Alternatively, the second heat generating layer 776 may be made of a magnetic shunt alloy that generates heat below a predetermined temperature and does not generate heat at or above the predetermined temperature.

Types of the image forming apparatus according to the present disclosure are not particularly limited. Aside from a printer, a copier, a facsimile machine, and multi-functional peripheral thereof may also be used.

The recording medium is not limited to paper. For example, a film (e.g., transparency) sheet may also be used.

Having thus described in detail various illustrative embodiments of the present disclosure, it is to be understood that the subject matter disclosed by the foregoing paragraphs is not to be limited to particular details and/or embodiments set forth in the above description, as many apparent variations thereof are possible without departing from the spirit or scope of the present disclosure.

What is claimed is:

1. An image forming apparatus comprising:

an image bearing member that has a surface on which an electrostatic latent image is capable of being formed;

a developing device that is operable to develop the electrostatic latent image formed on the image bearing member as a toner image;

a transferring portion that is operable to directly or indirectly transfer the toner image formed on the image bearing member to a recording medium;

a fixing device that is operable to fix the toner image transferred to the recording medium on the recording medium;

a cover member configured to be opened to an opened position at which the fixing device is exposed and to be closed to a closed position at which the fixing device is covered in a state in which the fixing device is held in a main body of the image forming apparatus; and an urging portion configured to urge the induction heating portion such that the induction heating portion is located in a position away from a reference position and closer to the cover member than the reference position in the image forming apparatus in a case in which the cover member is in the opened position, the fixing device including:

a fixing rotator unit; and an induction heating portion, the fixing rotator unit including:

a heating rotary belt;

a pressing member that is arranged inside the heating rotary belt and is in contact with an inner surface of the heating rotary belt;

a pressurizing rotator that is arranged so as to face the heating rotary belt, the heating rotary belt being sandwiched between the pressing member and the pressurizing rotator, the pressurizing rotator and the heating rotary belt forming a fixing nip therebetween; and a belt guide member that includes a guide portion being in contact with the inner surface of the heating rotary belt and an extending portion that extends from the guide portion, the belt guide member being configured to position the heating rotary belt and to guide rotation of the heating rotary belt, the induction heating portion including:

a magnetic-flux generating portion that is arranged so as to face an outer surface of the heating rotary belt and is operable to generate a magnetic flux for causing the heating rotary belt to generate heat;

a magnetic core portion configured to form a magnetic path for the magnetic flux generated by the magnetic-flux generating portion; and a support member configured to support the magnetic-flux generating portion and to face the outer surface of the heating rotary belt, wherein the support member includes a positioning portion configured to position the belt guide member by coming into contact with or engaging the extending portion to control a distance between the magnetic-flux generating portion and the outer surface of the heating rotary belt.

2. The image forming apparatus according to claim 1, wherein the positioning portion includes an engaging portion, and the extending portion includes an engaged portion capable of being engaged with the engaging portion.

3. The image forming apparatus according to claim 2, wherein the engaging portion comprises an elastic member.

4. The image forming apparatus according to claim 1, wherein the extending portion includes a facing surface that faces the support member, and the positioning portion includes a contact portion capable of coming into contact with the facing surface.

5. The image forming apparatus according to claim 1, wherein the fixing rotator unit is capable of coming into contact with and separating from the induction heating portion.

6. The image forming apparatus according to claim 1, wherein the heating rotary belt includes a first heat generating layer thinner than a skin depth that is a depth of penetration of a magnetic flux generated by the magnetic-flux generating portion, and the belt guide member includes a second heat generating layer caused to generate heat by a magnetic flux that has passed through the heating rotary belt.

7. The image forming apparatus according to claim 1, wherein the urging portion does not urge the induction heating portion in a case in which the cover member is in the closed position.

8. The image forming apparatus according to claim 1, further comprising:

a movable rod configured to move in conjunction with opening and closing of the cover member; and a swing arm configured to be in contact with the movable rod and to be capable of swinging in the image forming apparatus, wherein the swing arm includes a core contact member being in contact with the urging portion.

9. The image forming apparatus according to claim 8, wherein in the case in which the cover member is in the opened position, the induction heating portion is located in the position away from the reference position and closer to the cover member than the reference position in the image forming apparatus by the core contact member coming into contact with the magnetic core portion.

10. The image forming apparatus according to claim 1, wherein the positioning portion configured to position the belt guide member by coming into contact with or engaging the extending portion controls the distance between the magnetic-flux generating portion and the outer surface of the heating rotary belt such that the distance is substantially uniform.

* * * * *